US009174320B1

(12) United States Patent
Meyer

(10) Patent No.: US 9,174,320 B1
(45) Date of Patent: Nov. 3, 2015

(54) HAMMER UNION RESTORATION APPARATUS

(71) Applicant: Kevin R. Meyer, Belgrade, MT (US)

(72) Inventor: Kevin R. Meyer, Belgrade, MT (US)

( * ) Notice: Subject to any disclaimer, the term of this patent is extended or adjusted under 35 U.S.C. 154(b) by 0 days.

(21) Appl. No.: 14/120,520

(22) Filed: May 28, 2014

Related U.S. Application Data

(60) Provisional application No. 61/956,258, filed on Jun. 4, 2013.

(51) Int. Cl.
*B24B 21/02* (2006.01)
*B24B 7/10* (2006.01)

(52) U.S. Cl.
CPC ..... *B24B 7/10* (2013.01)

(58) Field of Classification Search
CPC ..... B24B 7/10; B24B 21/002; B24B 3/54; B24B 21/004; B24B 21/008; B24B 21/02; B24B 47/22; B24B 47/20; B24B 49/04; B24B 49/16; B24B 49/18; B24B 37/345; B24B 27/0076
USPC ..... 451/302, 403, 8, 65, 66, 233
See application file for complete search history.

(56) References Cited

U.S. PATENT DOCUMENTS

| | | | | |
|---|---|---|---|---|
| 715,524 | A | 12/1902 | Tyberg | |
| 1,033,837 | A | 7/1912 | Smith | |
| 1,198,967 | A | 9/1916 | Stempert | |
| 1,860,840 | A | 5/1932 | Marsilius et al. | |
| 2,222,361 | A * | 11/1940 | Burns | 451/302 |
| 2,489,811 | A | 11/1949 | Perkins | |
| 2,648,174 | A * | 8/1953 | Bikles | 451/194 |
| 2,768,476 | A * | 10/1956 | Jerome et al. | 451/192 |
| 2,896,378 | A * | 7/1959 | Keating | 451/307 |
| 3,024,575 | A * | 3/1962 | Dreiling | 451/1 |
| 3,203,139 | A * | 8/1965 | Giese | 451/57 |
| 3,471,974 | A | 10/1969 | Korth et al. | |
| 3,538,650 | A * | 11/1970 | Pollak | 451/297 |
| 3,994,100 | A | 11/1976 | Shelden et al. | |
| 5,367,866 | A | 11/1994 | Phillips | |
| 5,437,125 | A * | 8/1995 | Barton, II | 451/8 |
| 6,544,108 | B2 * | 4/2003 | McCoy | 451/49 |
| 8,261,631 | B2 * | 9/2012 | Weil et al. | 74/825 |
| 2012/0038146 | A1 * | 2/2012 | Curtiss | 285/81 |
| 2014/0260822 | A1 * | 9/2014 | Dumaine et al. | 81/119 |

* cited by examiner

*Primary Examiner* — George Nguyen
(74) *Attorney, Agent, or Firm* — Richard C. Conover

(57) ABSTRACT

The present invention relates to a hammer union restoration apparatus wherein a main sanding unit is mounted to a base. The main sanding unit including a sander for sanding the four side faces of a lug formed on the hammer union. The sander being resiliently movable in a direction away from a side face of the lug. The sander is movable under control of a motor to rotate the sander relative to the lug around the four faces of the lug with the sander floating across the corner edges of the four faces. The present invention further includes a sander for sanding the end face of the lug.

6 Claims, 28 Drawing Sheets

HAMMER UNION RESTORATION APPARATUS

This application claims the benefit of provisional application Ser. No. 61/956,258 filed Jun. 4, 2013.

BACKGROUND OF INVENTION

A hammer union is a device for joining together pipes normally carrying high pressure fluids. The hammer union must be tightened on the pipe because the pipe is under enormous pressures. These hammer unions are tightened by using a hammer to pound on lugs provided on the hammer union. In doing so, the lugs are deformed by continued use creating sharp edges and deformations on the lugs. The present invention is directed to apparatus for restoring the lugs on these hammer unions. Previously, the hammer unions had to be restored manually taking a lot of time and, in some cases, causing injury. With the present invention, these hammer unions are restored quickly and with little chance of injury.

SUMMARY OF INVENTION

The present invention relates to a hammer union restoration apparatus wherein a main sanding unit is mounted to a base. The main sanding unit including a sander for sanding the four side faces of a lug formed on the hammer union. The sander being resiliently movable in a direction away from a side face of the lug. The sander is movable under control of a motor to rotate the sander relative to the lug around the four faces of the lug with the sander floating across the corner edges of the four faces. The present invention further includes an auxiliary sanding unit having a sander for sanding the end face of the lug.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
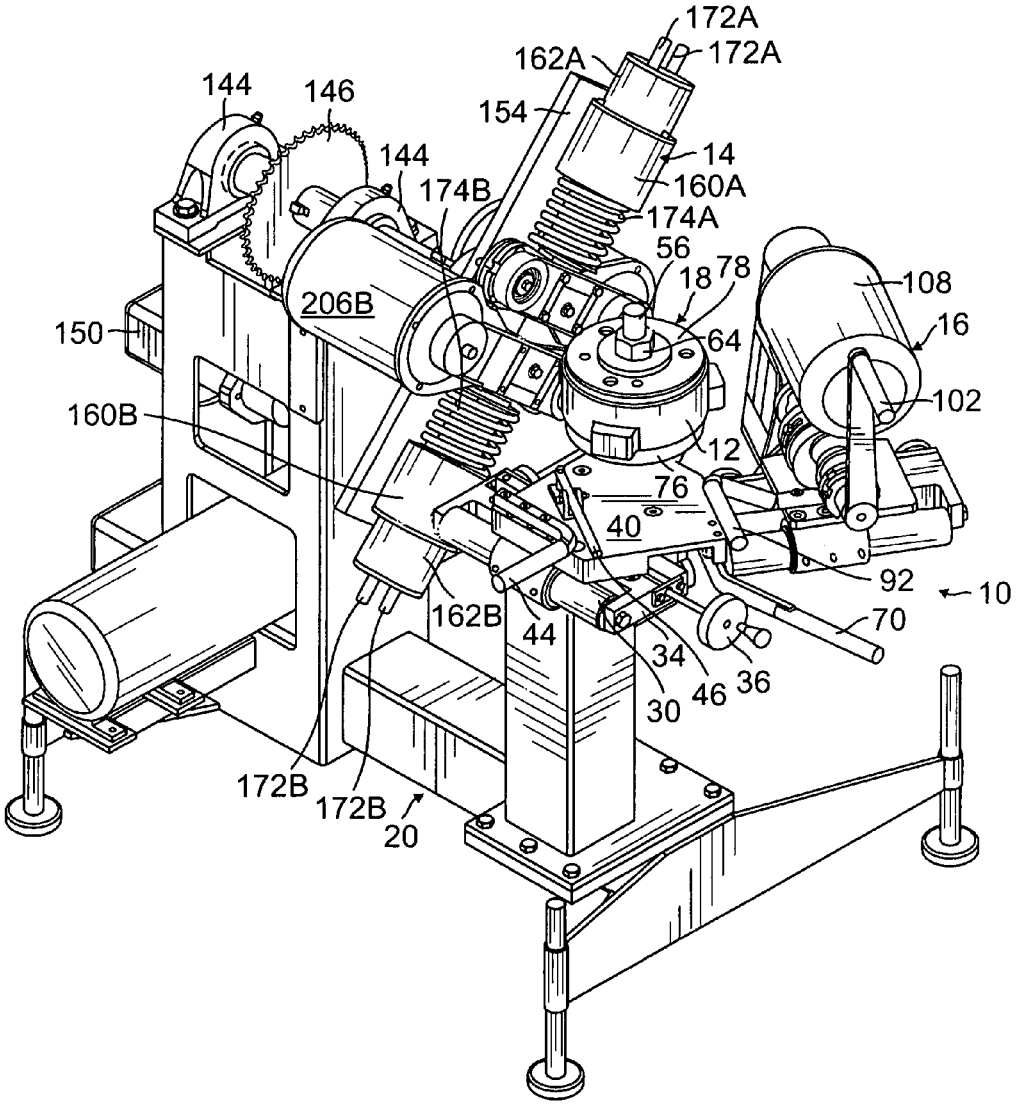
FIG. 1 is a perspective view with parts broken away showing a hammer union restoration apparatus according to the present invention.
Figure 2A:
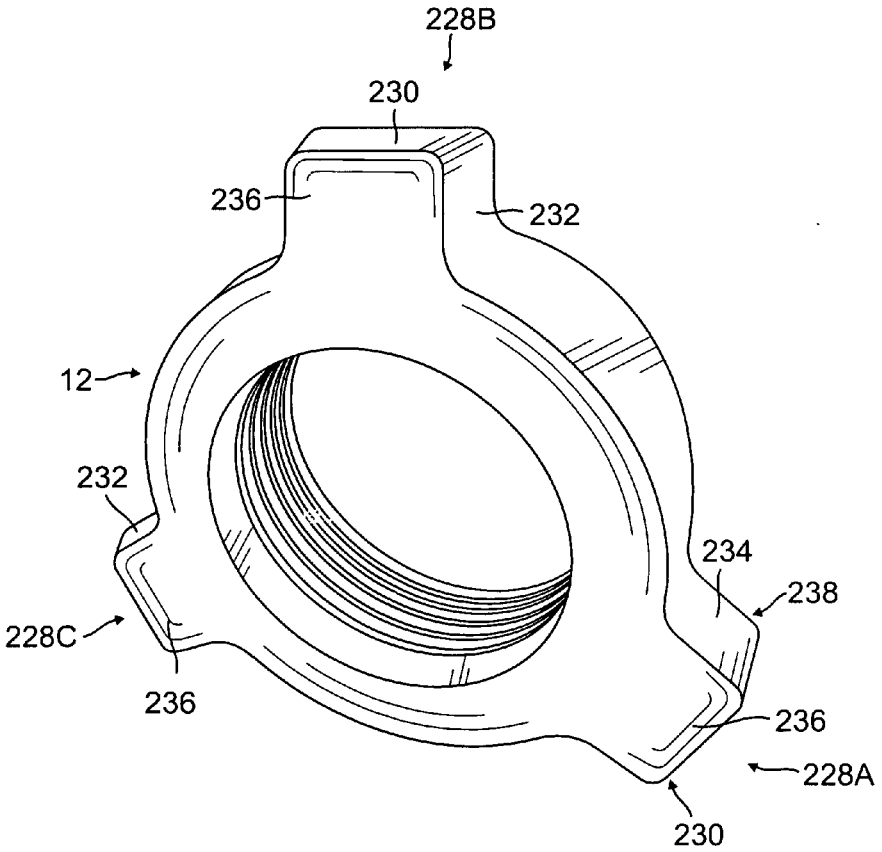
FIG. 2A is a top perspective view of a hammer union.
Figure 2B:
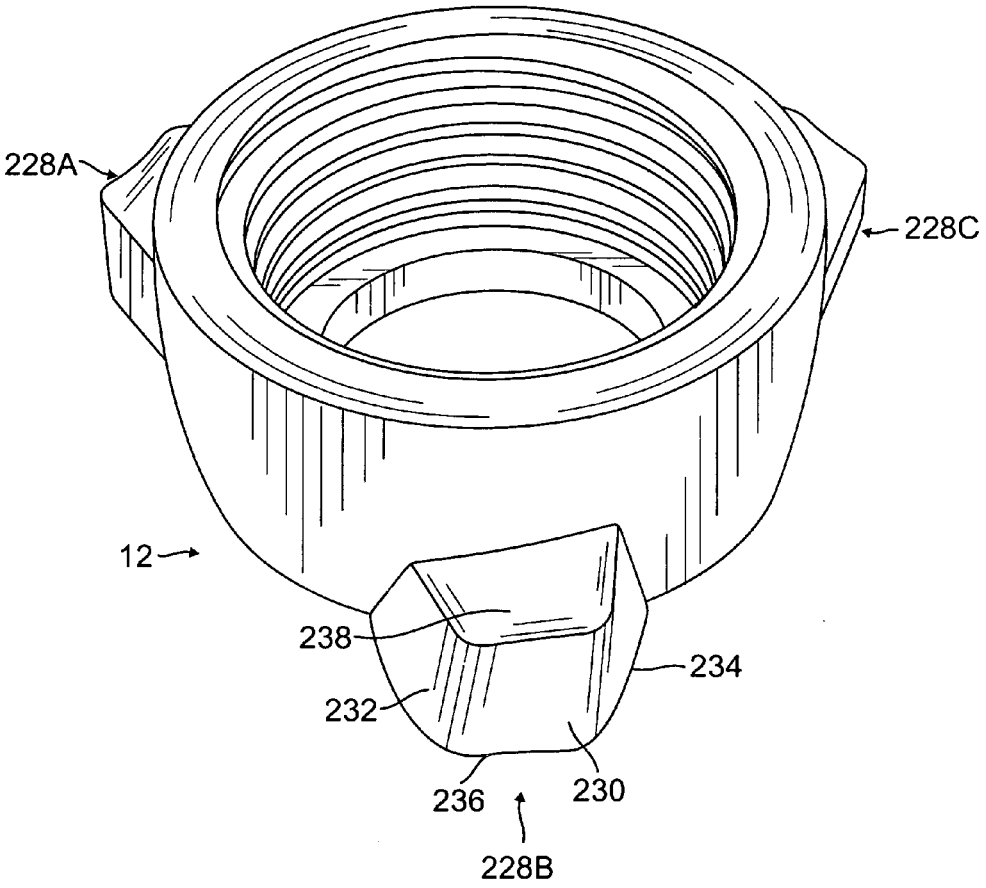
FIG. 2B is a bottom perspective view of a hammer union.

A hammer union restoration apparatus 10 is shown in FIG. 1 for restoring a hammer union 12 shown in FIGS. 2A and 2B. The apparatus 10 includes a main sanding assembly 14, an auxiliary sanding assembly 16 and a hammer union holder assembly 18, all resting on a stand 20.

Figure 3:
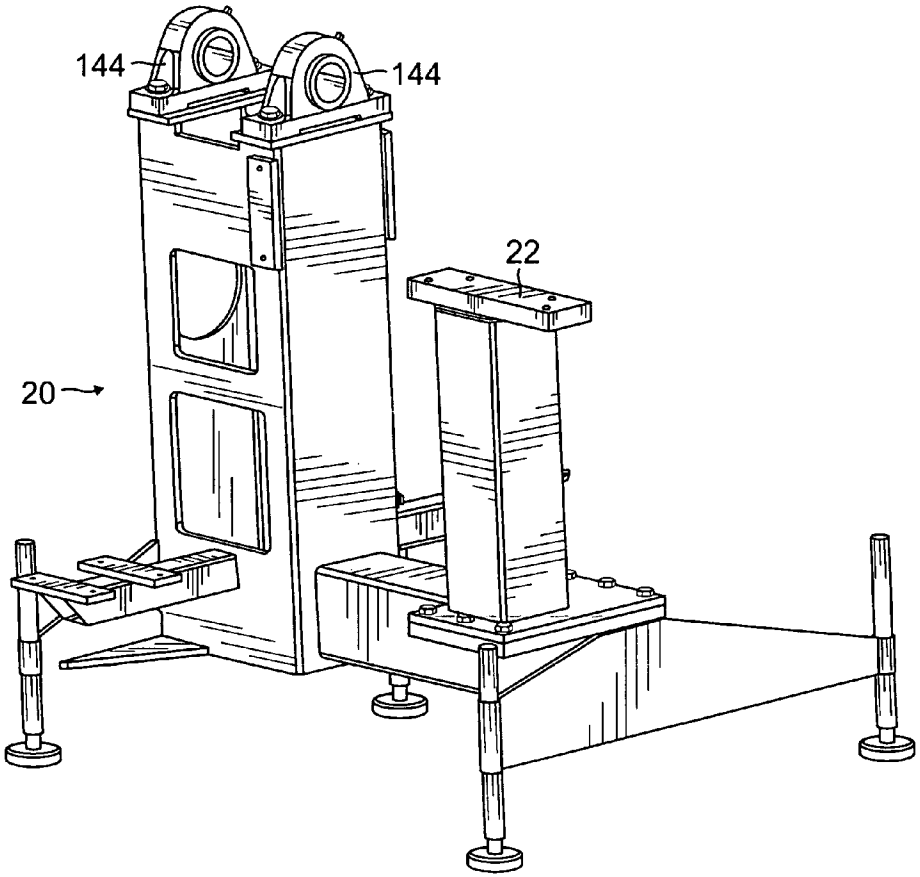
FIG. 3 is a perspective view of a stand used with the present invention.
Figure 4:
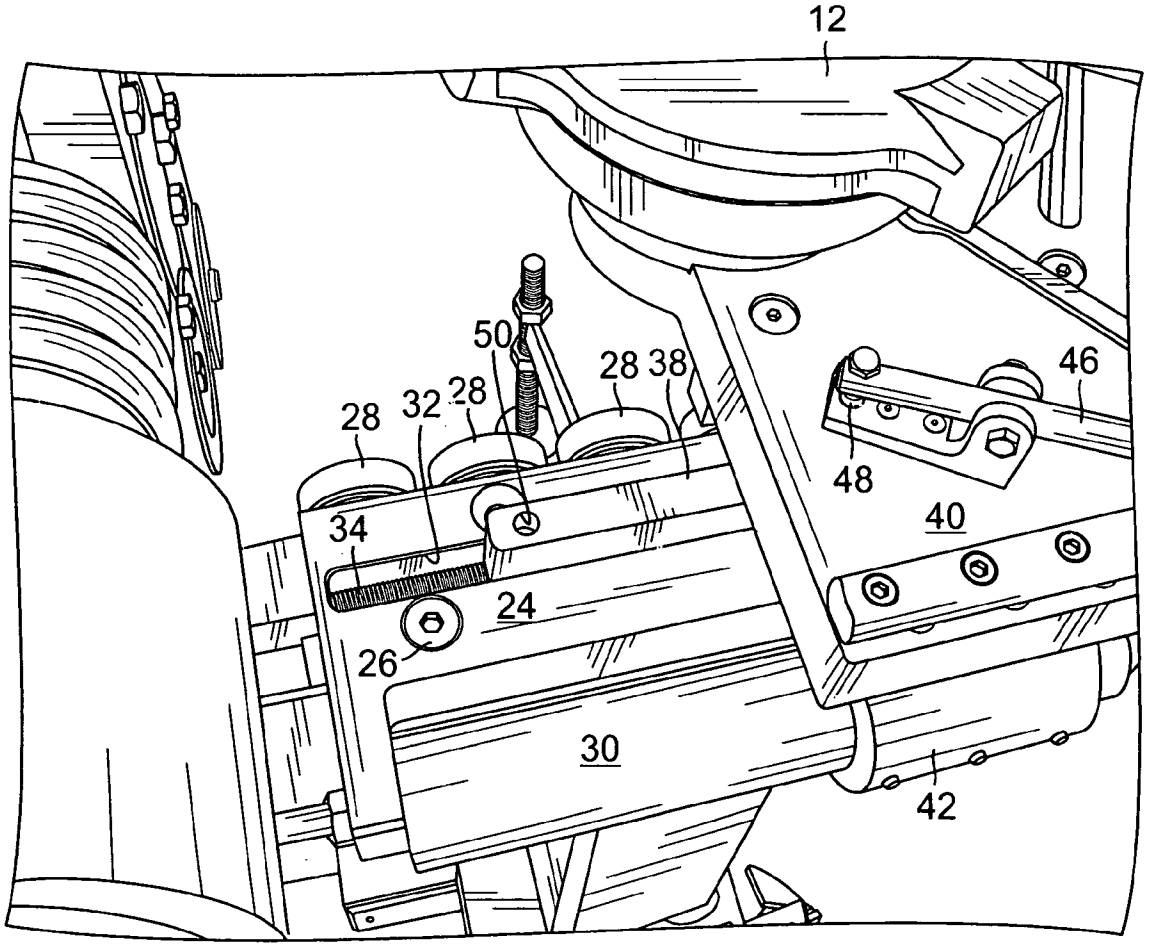
FIG. 4 is a detail perspective view of a hammer union holder assembly used with the present invention.

The stand 20 is shown in FIG. 3. The stand 20 includes a mounting bracket 22. The hammer union holder assembly 18 is shown in FIGS. 1 and 4 and is mounted to the stand 20 by securing a base platform 24 to the mounting bracket 22 with mounting screws 26 as shown in FIG. 4. The base platform 24 includes a plurality of in-line roller wheels 28 along one edge thereof. Along an opposite edge of the base platform 24 is mounted a round shaft 30. The base platform 24 further includes a slot 32 in which is mounted for rotational movement a machine screw 34 which may be rotated with a crank handle 36. An adjustment bar 38 is threadably secured to the machine screw 34 within the slot 32. The adjustment bar 38 is moved longitudinally in the slot 32 upon rotation of the crank handle 36.

Figure 5:
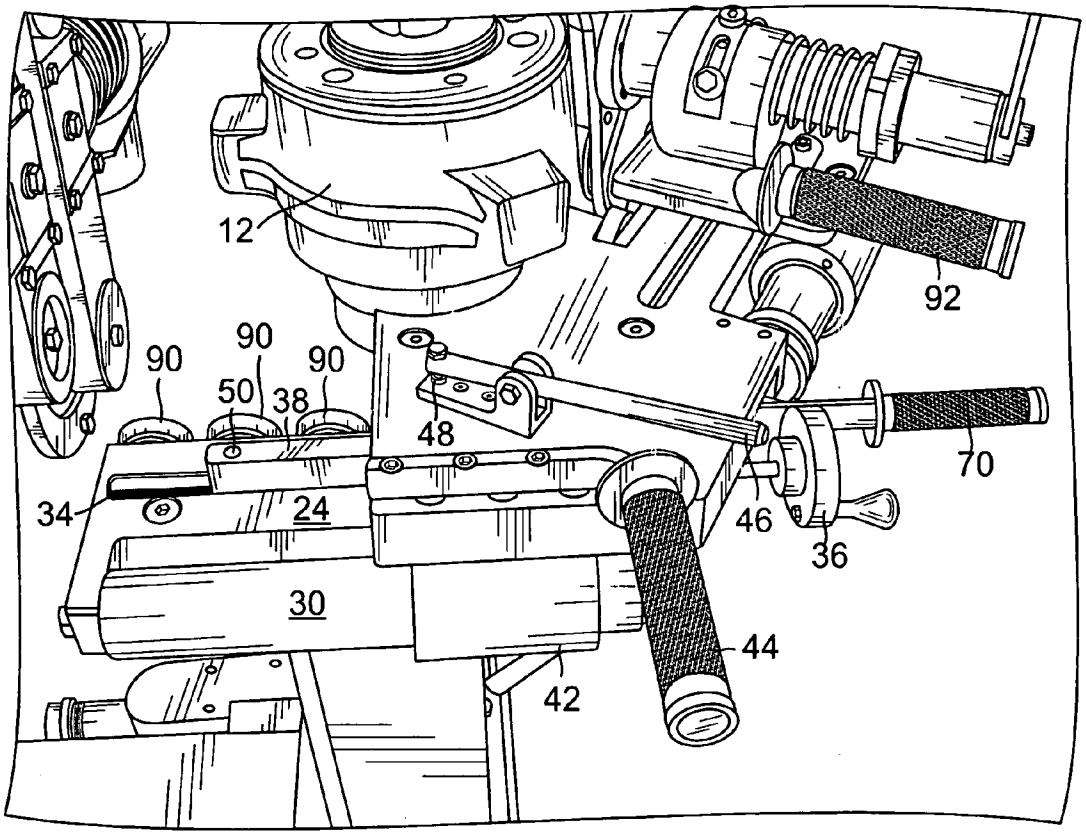
FIG. 5 is a detail perspective view of a hammer union holder assembly used with the present invention.

A slide plate 40 is slidably mounted on the base platform 24 with a tubular member 42 afixedly mounted to the slide plate 40 and slidably mounted on the round shaft 30 as shown in FIGS. 4 and 5. A handle 44 fixedly attached to slide plate 40 is used to slide slide plate 40 along round shaft 30.

A lever arm 46 is pivotally mounted on the slide plate 40 and includes a pin 48 at one end thereof which extends through a hole (not shown) in slide plate 40. As the slide plate 40 is moved to the left as shown in FIG. 5, the pin 38 is positioned to drop into index hole 50 thereby further preventing slidable movement of slide plate 40 with respect to the base platform 24. When it is desired to move the slide plate 40 to the right as shown in FIG. 5, the lever arm 46 is depressed thereby removing the pin 48 from the index hole 50.

Figure 6:
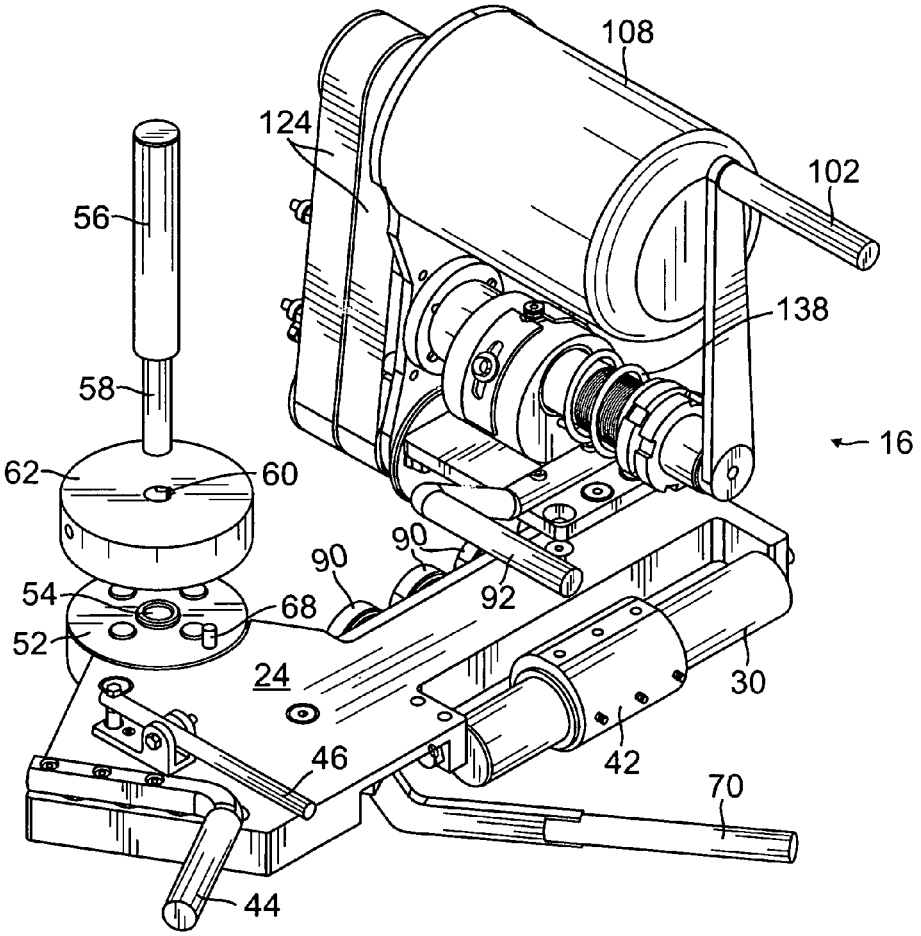
FIG. 6 is a detail perspective view of an auxiliary sanding assembly used with the present invention.
Figure 7:
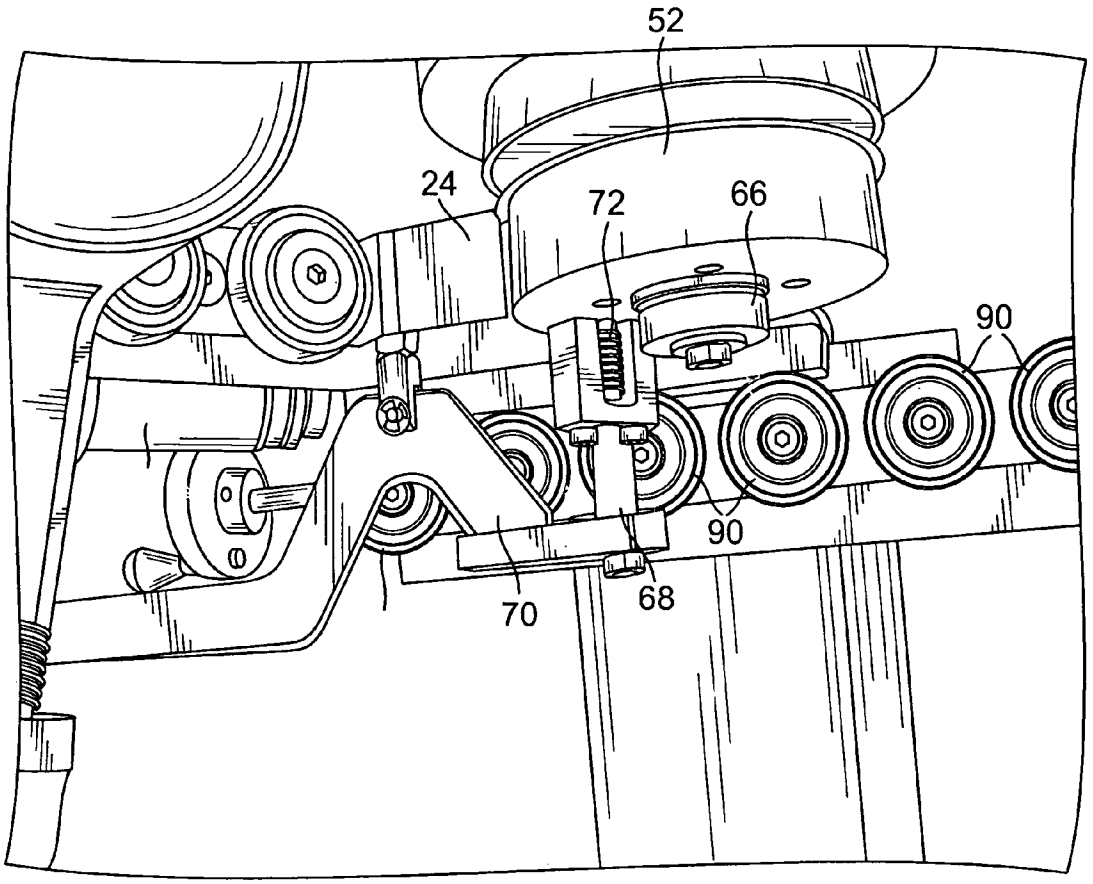
FIG. 7 is a detail perspective view of the auxiliary sanding assembly.

The base platform 24 includes a protruding portion 52 as shown in FIG. 6. The portion 52 includes an opening 54. A threaded post 56 includes a reduced diameter portion 58 which is received by a hole 60 provided in a post base 62 and opening 54 of the protruding portion 52. The post 56 is secured in position with a bolt 64 extending through a collar 66 as shown in FIG. 7. The bolt 64 is tightened sufficiently to mount the post 56 to the protruding portion 52 but allows for slidable rotational movement of the post base 62 with respect to the protruding portion 52.

Figure 8:
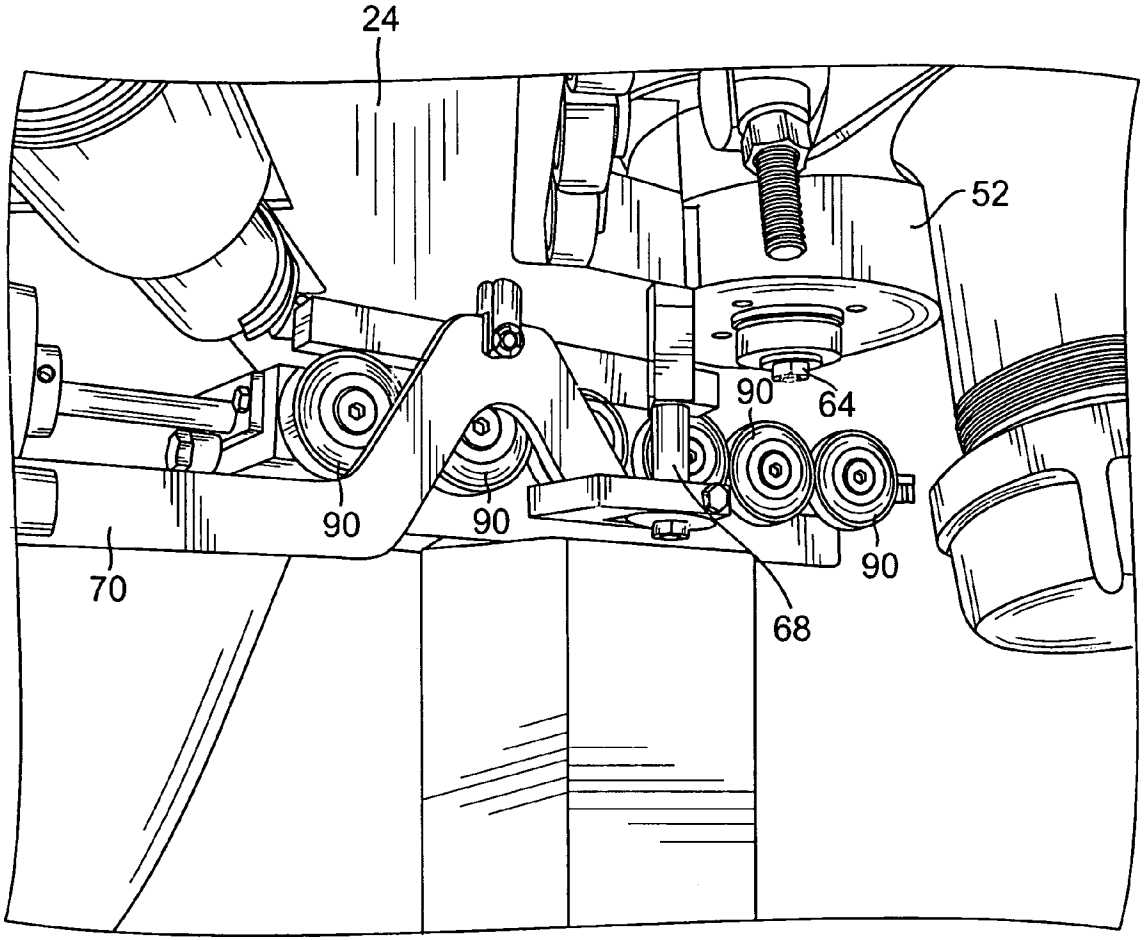
FIG. 8 is a detail perspective view of a portion of the auxiliary sanding assembly.
Figure 9:
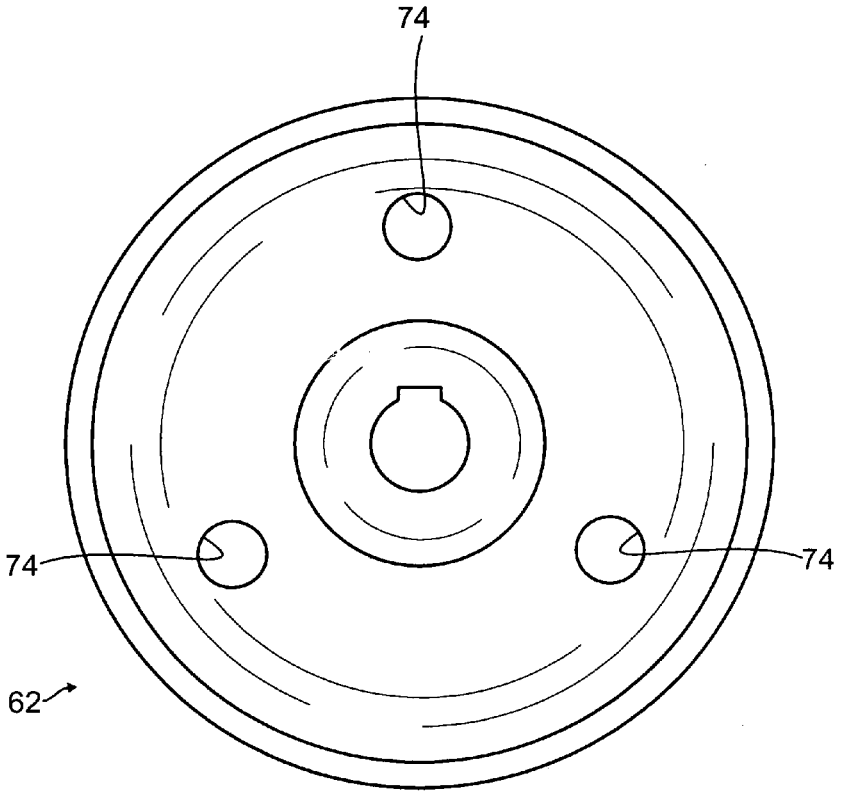
FIG. 9 is a bottom view of a post base used with the present invention.

A retractable pin 68 is positioned in a hole (not shown) provided in the protruding portion 52 as shown in FIG. 6. The post base 62 on the underside thereof is provided with three circumferentially located index holes spaced 120° apart for receiving the pin 68 as shown in FIG. 9. A lever arm 70 shown in FIGS. 6 and 8 is pivotally mounted to the base assembly 24. The lever arm 70 has one end attached to the pin 68 as shown in FIG. 7. A compression spring 72 is provided to resiliently force the pin 68 upwardly toward the protruding portion 52 thereby causing the pin 68 to be resiliently located in a selected index hole 74 of the post base 62. When it is desired to rotate the post base 62 with respect to the protruding portion 52, the lever arm 70 is raised thereby retracting pin 68 from index hole 74.

Figure 11:
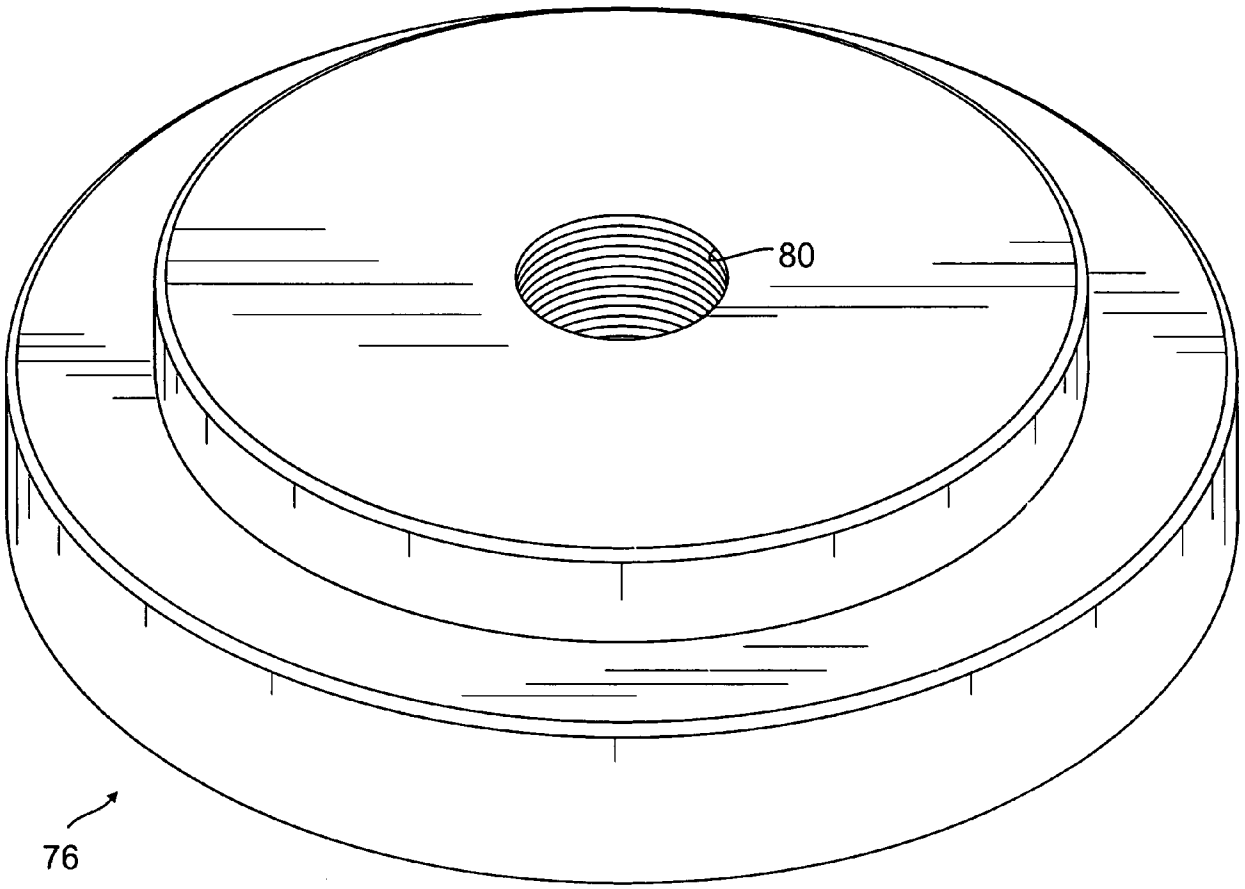
FIG. 11 is a perspective view of a bottom plate used to hold a hammer union.
Figure 12:
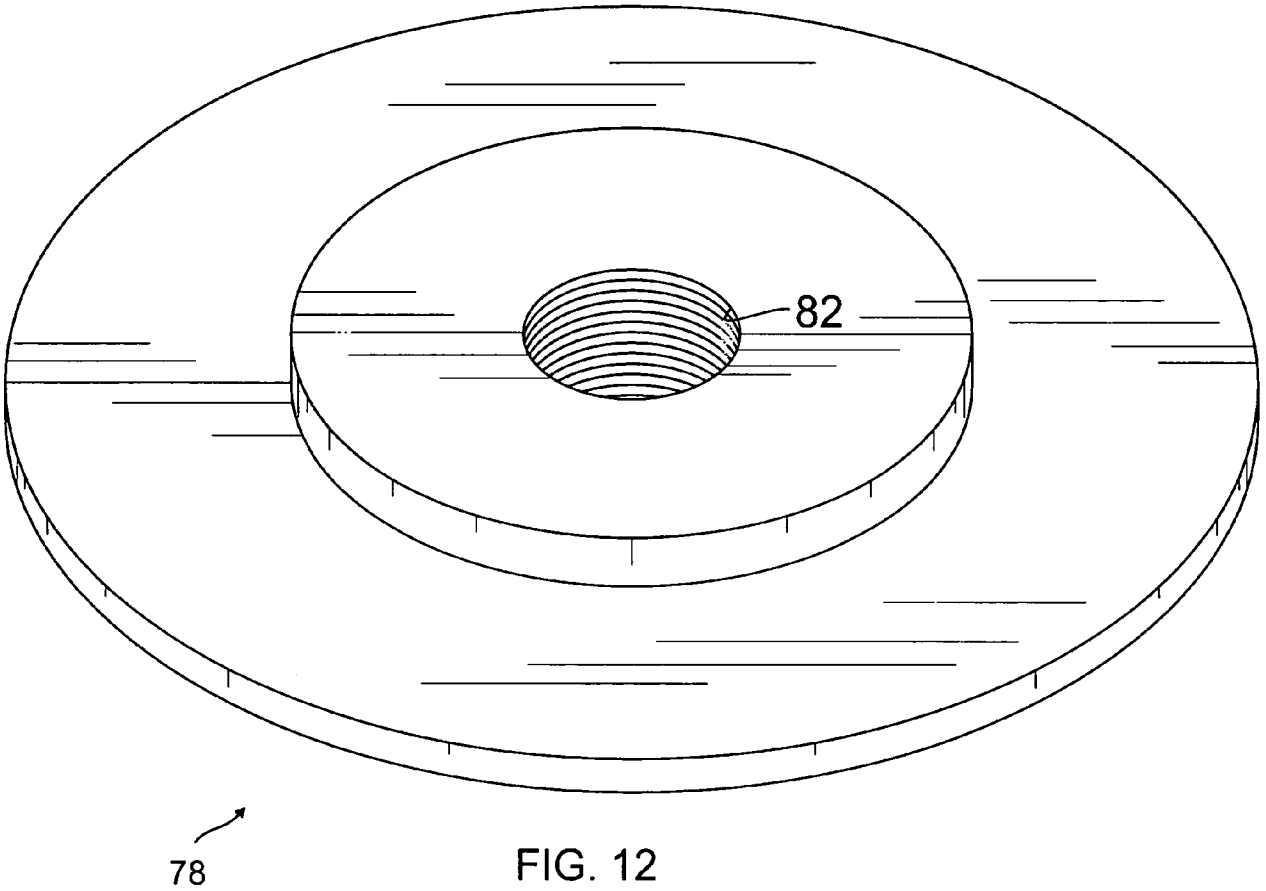
FIG. 12 is a perspective view of a top plate used for holding a hammer union.

A hammer union 12 is mounted on the post 56 sandwiching the hammer union 12 between a bottom plate 76 and a top plate 78. The bottom plate is shown in FIG. 11 and the top plate is shown in FIG. 12. The post extends through a central hole 80 in the bottom plate 76 and also through a hole 82 provided in the top plate 78. A nut 64 as shown in FIG. 1 secures the hammer union 12 onto the post 56.

Figure 10:
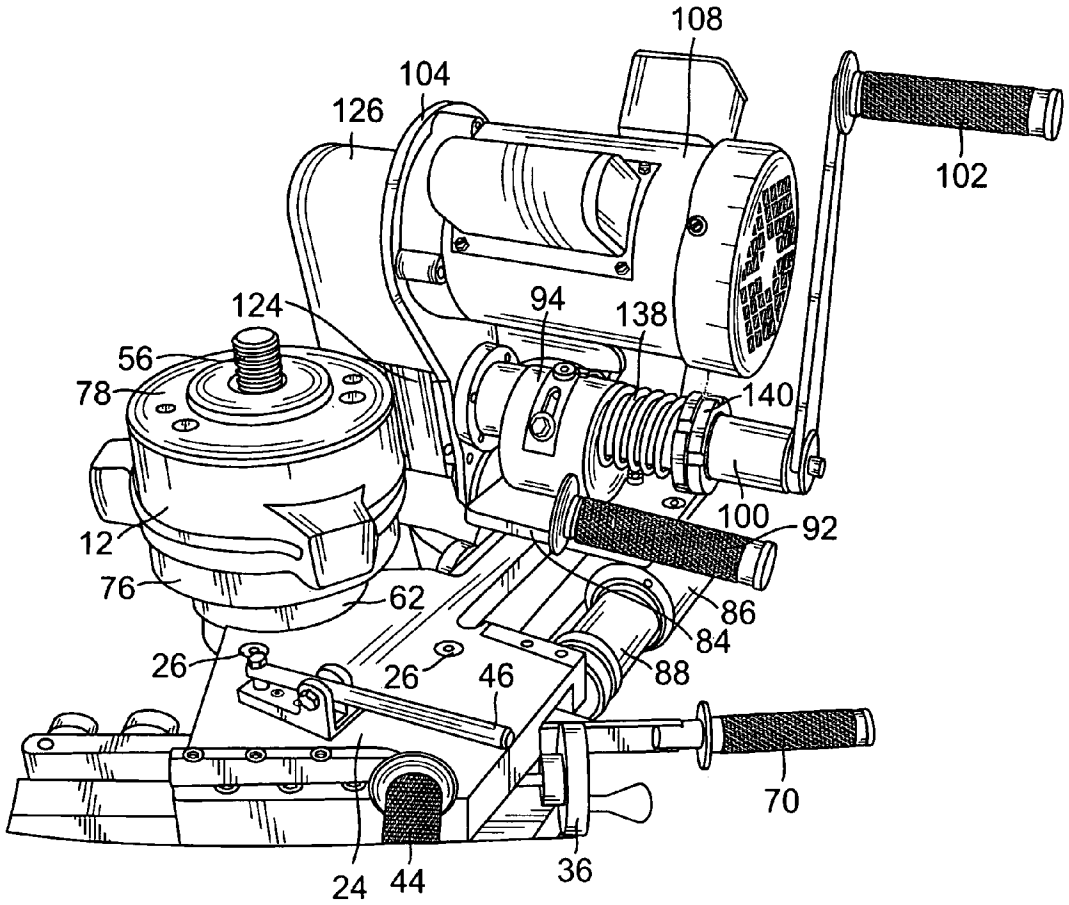
FIG. 10 is a perspective view of the auxiliary sanding assembly.
Figure 13:
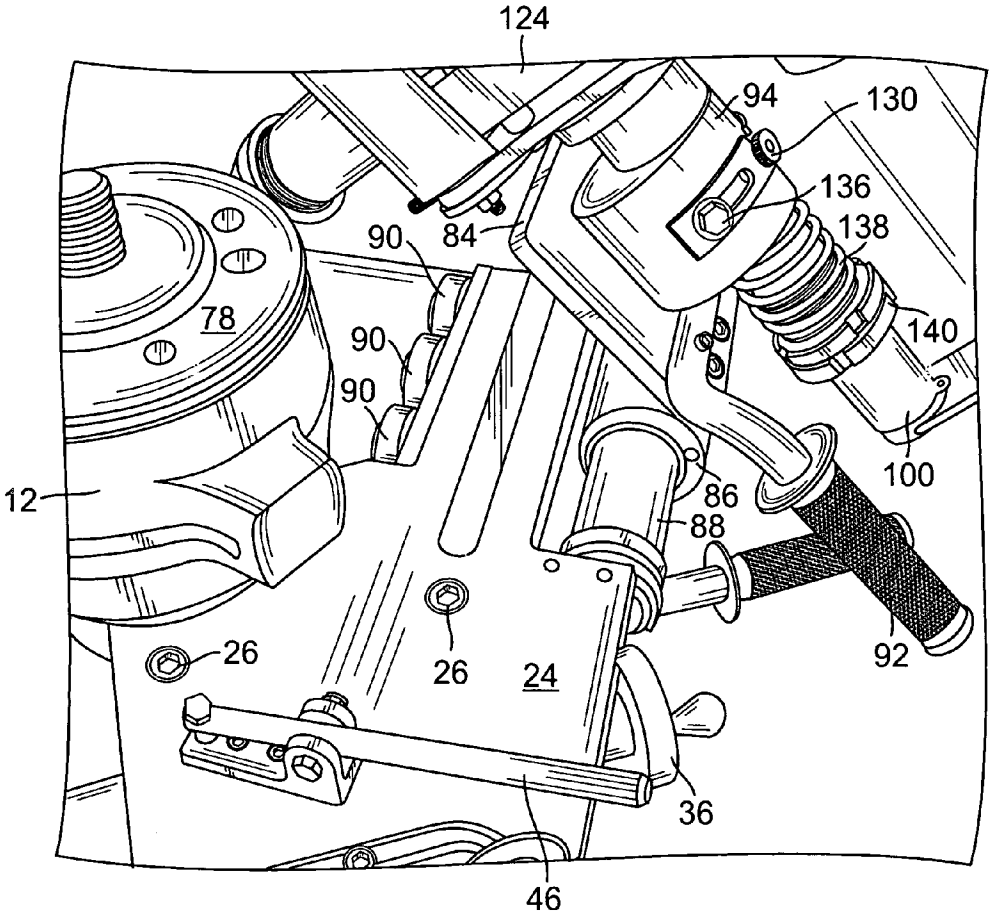
FIG. 13 is a detail perspective view of the auxiliary sanding assembly.

The auxiliary sanding assembly 16 as shown in FIGS. 1 and 10. The auxiliary sanding assembly 16 includes a base plate 84 as shown in FIGS. 10 and 13. The base plate 84 is fixedly mounted to a tubular member 86 which is slidably mounted on a round shaft 88 which in turn is fixedly mounted to base platform 24. A series of roller wheels 90 are rotatably mounted to the base platform 24 along an edge and in-line and parallel with the axis of tubular shaft 88. When the base plate 84 rests on the base platform 24 the roller wheels 90 allow for frictionless slidable movement of the base plate 84 on the base platform 24.

Figure 15:
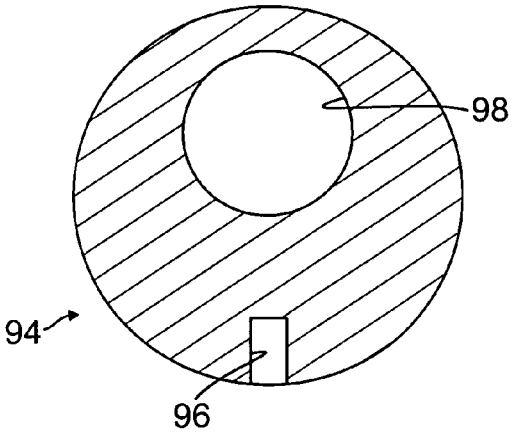
FIG. 15 is a cross sectional view taken along the line 15-15 in FIG. 14B.

A bearing mount 94 is bolted to the base plate 84 with a bolt (not shown) extending into a threaded bore 96 as shown in FIG. 15. The bearing mount 94 further includes a bore 98 for rotatably receiving an axle 100. A handle 102 is mounted to one end of the axle 100. The opposite end of axle 100 is fixedly mounted to a motor mount plate 104 with screws 106 as shown in FIG. 16.

Figure 16:
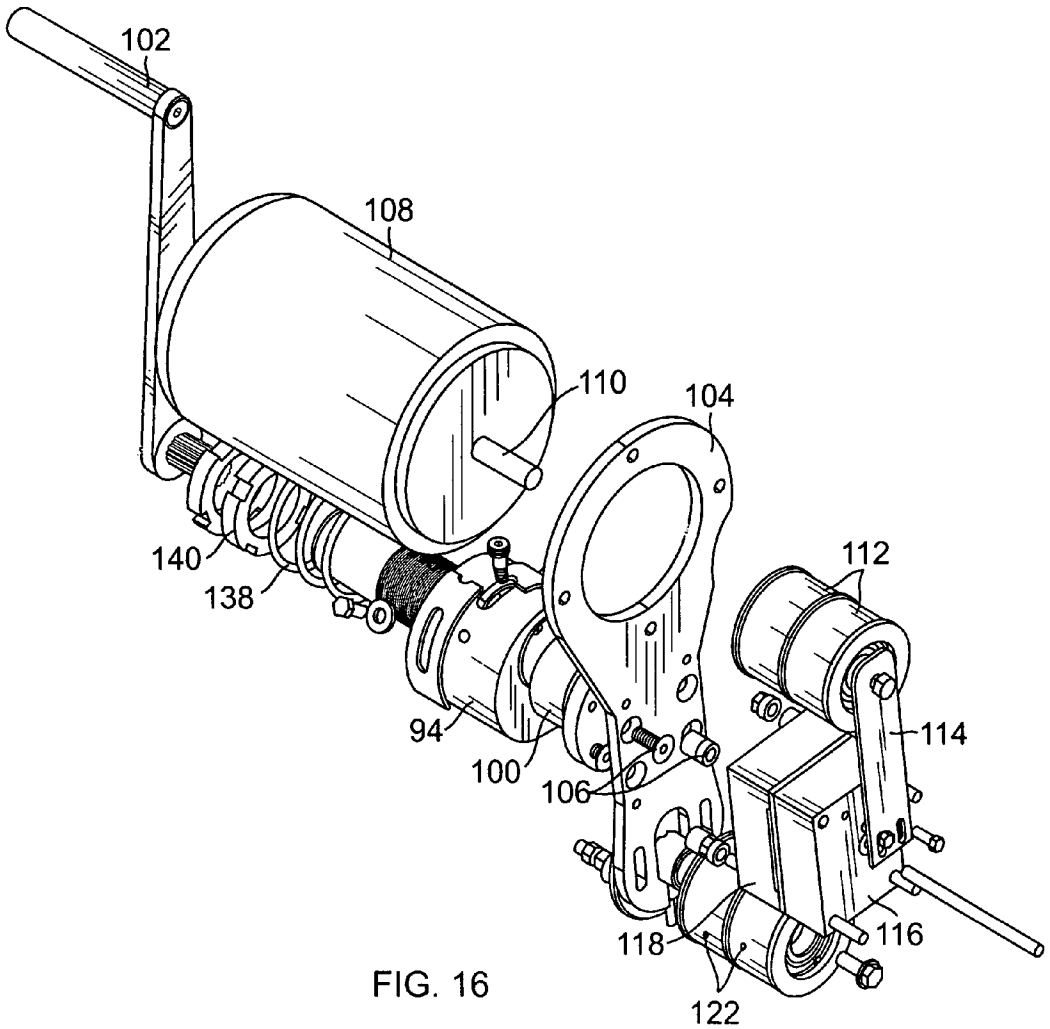
FIG. 16 is an exploded partial view of the auxiliary sanding assembly.
Figure 17:
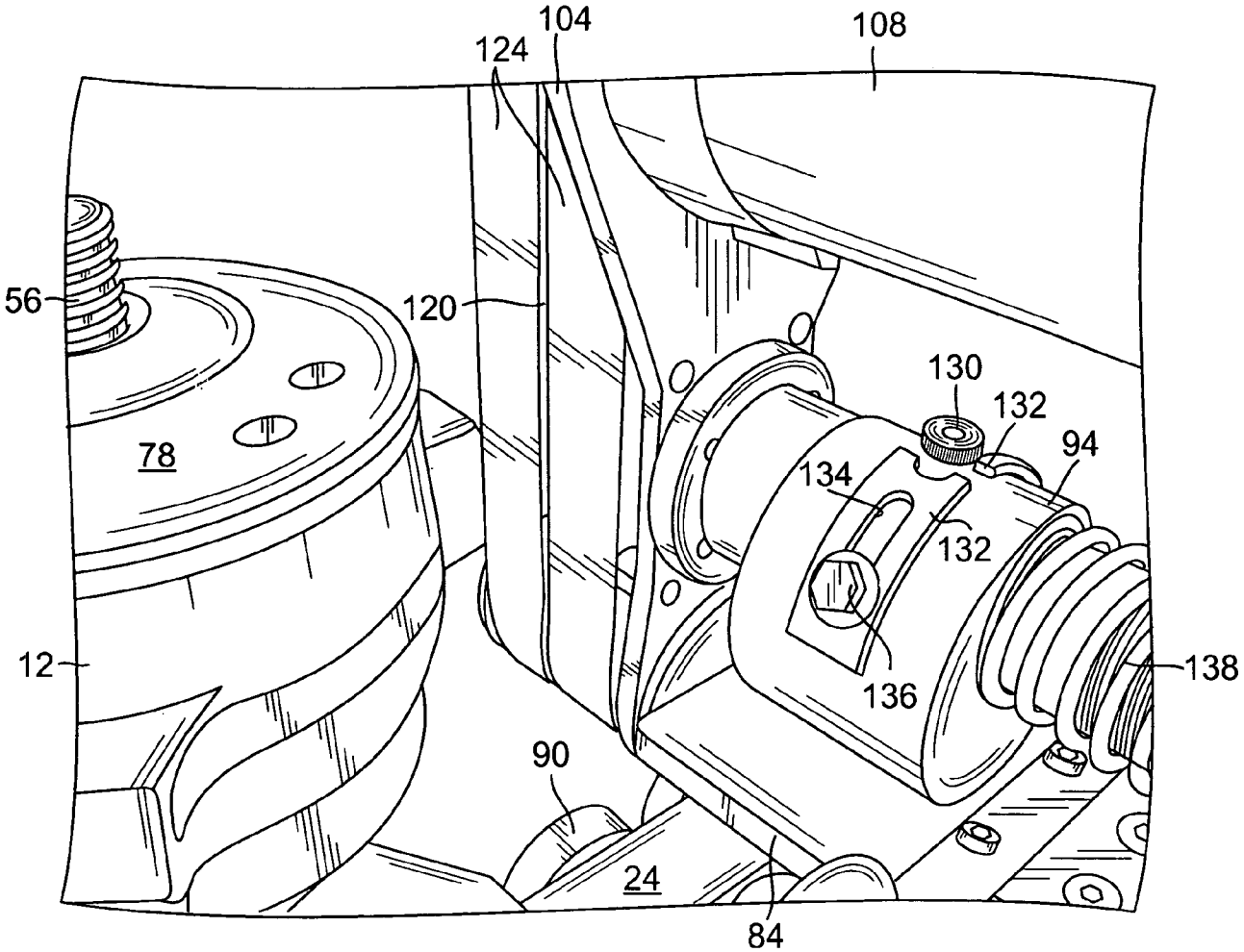
FIG. 17 is a detail perspective view of the auxiliary sanding assembly.

An electric motor 108 is mounted to the motor mount plate 104 as shown in FIGS. 10 and 16. An axle 110 of the electric motor 108 fixedly mounted to a pair of pulleys 112 for rotatably driving the pulleys 112. The pulleys 112 are rotatably mounted to a bracket 114 which in turn is mounted to a pair of sanding blocks 116 and 118. The blocks 116 and 118 have a depth limiter plate 120 sandwiched between them. The blocks 116, 118 and depth limiter plate 120 are all bolted to the motor mount 104. A pair of idler pulleys 122 are rotatably mounted to the motor mount 104. A pair of sanding belts 124 are each fitted on a respective driver pulley 112 and idler pulley 122 as shown in FIG. 17. A protective shield 126 is mounted to the motor mount plate 104 to cover the pulleys 112 as shown in FIG. 10.

Figure 14A:
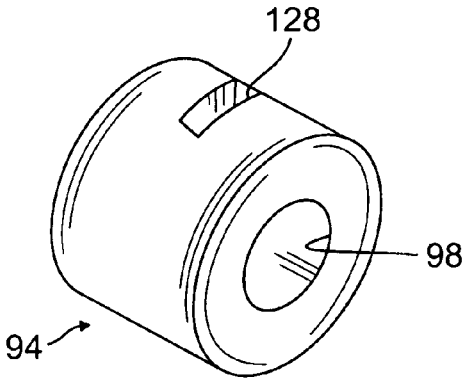
FIG. 14A is a perspective view of a bearing mount used with the present invention.
Figure 14B:
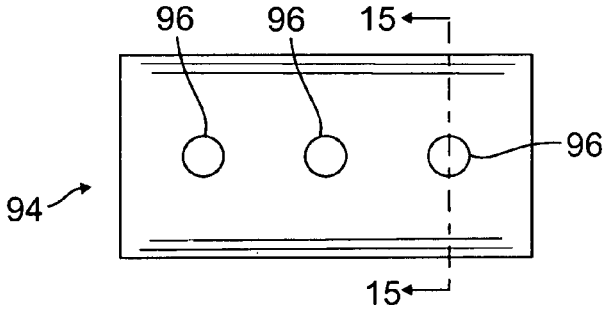
FIG. 14B is a bottom view of the bearing mount shown in FIG. 14A.

The bearing mount 94 includes a slot 128 as shown in FIG. 14A. A bolt 130 is slidably positioned within the slot 128 and is threadably received by the axle 100 as shown in FIGS. 16 and 17. A pair of stop plates 132 are provided on either side of the bolt 130 as shown in FIG. 17. The stop plates 132 include a slot 134. A bolt 136 is slidably received in slot 134 and threadably received by the bearing mount 94. As recognized, the rotational movement of the axle 100 is limited in one direction by the bolt 130 resting against one of the plates 132 and limited in the opposite direction by the bolt 130 resting against the other plate 132. The amount of rotational movement can be adjusted by loosening a respective bolt 136 and moving the associated stop plate 132 to a selected position.

A torsion spring 138 is mounted on the axle 100 and has one end secured to the bearing mount 94 and the opposite end mounted to a spring mount 140 affixed to the axle 100 as shown in FIGS. 10 and 16. The torsion spring 138 resiliently biases the auxiliary sanding assembly 16 in a clockwise direction as seen in FIG. 1.

Figure 18:
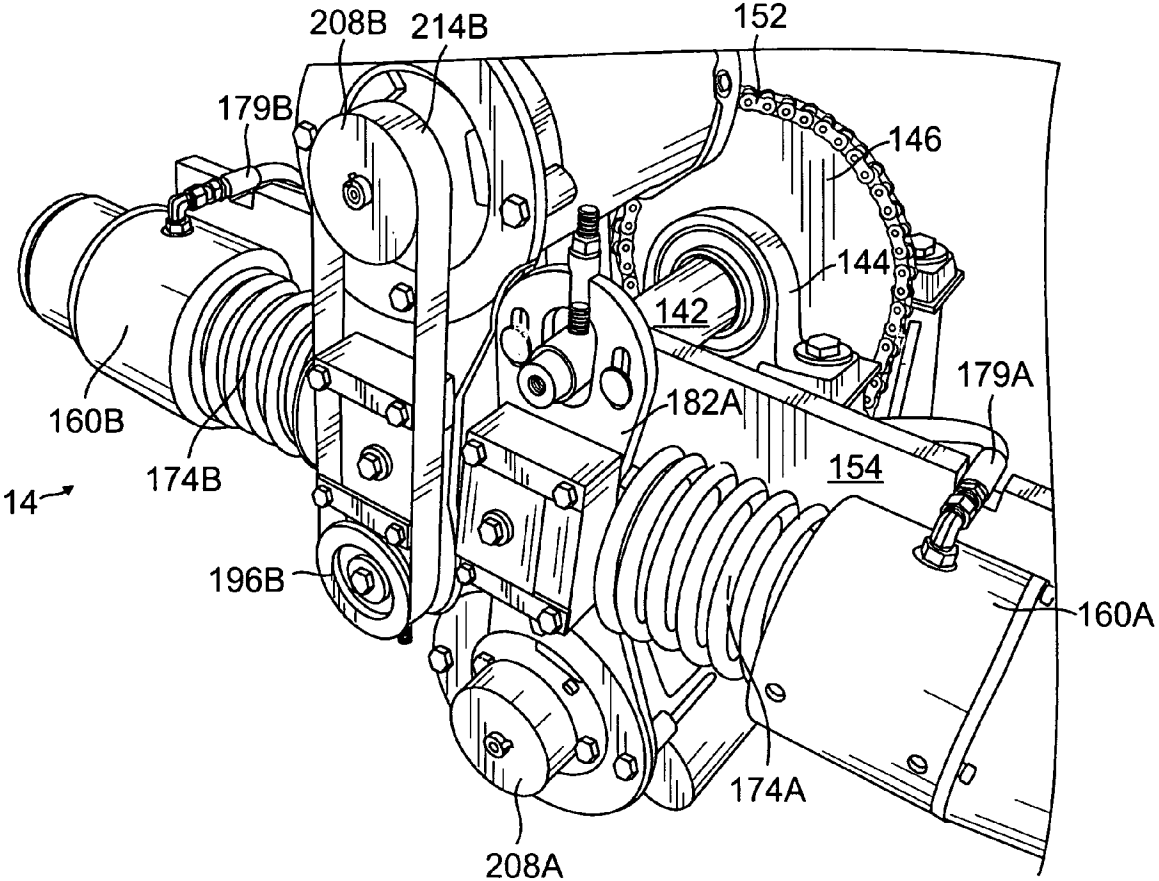
FIG. 18 is a partial perspective view of a main sanding assembly used with the present invention.
Figure 19:
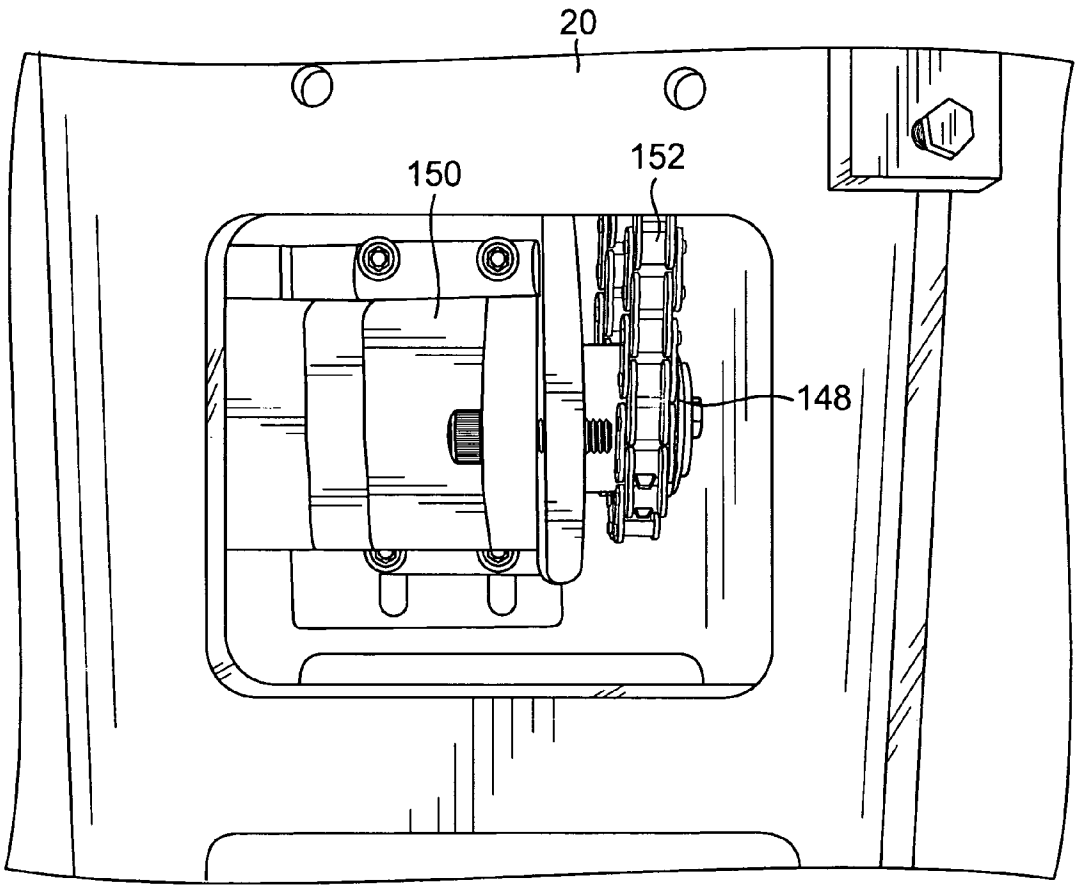
FIG. 19 is a detail view of the main sanding assembly.
Figure 24:
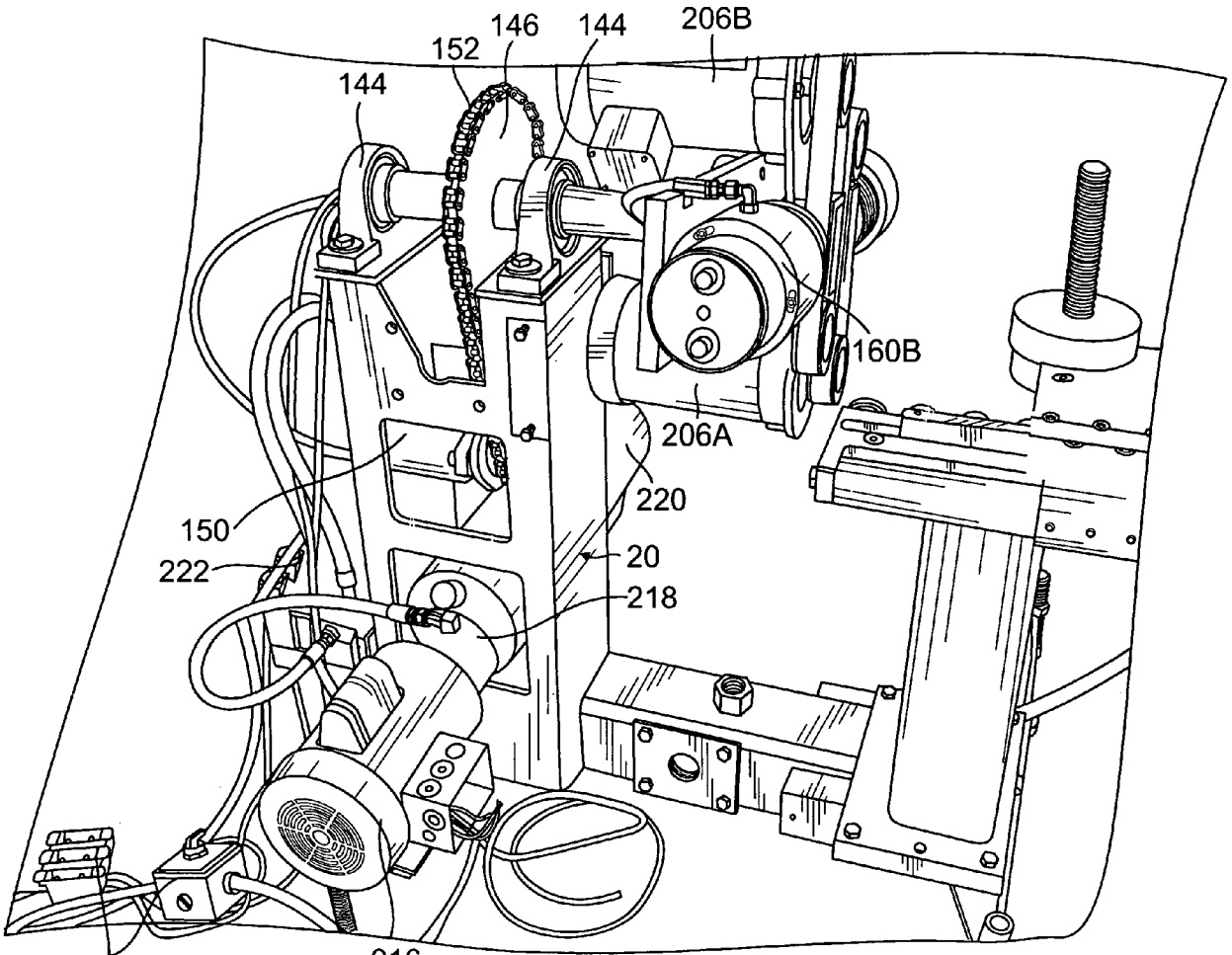
FIG. 24 is a left side perspective view of the main sanding assembly shown in FIG. 23.
Figure 26:
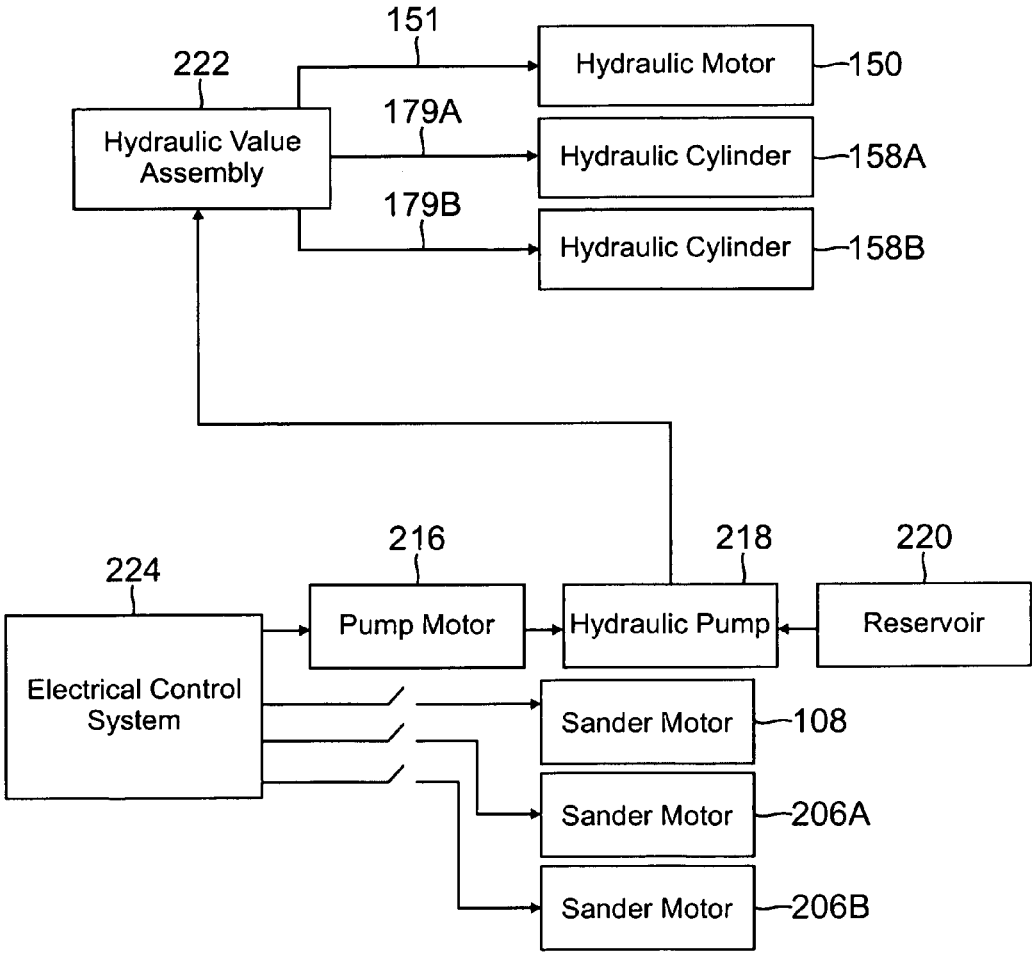
FIG. 26 is a schematic view showing the hydraulic and electrical systems used with the present invention.

The main sanding assembly 14 is shown in FIGS. 1 and 18. The main sanding assembly 14 includes an axle 142 journaled in a pair of bearing blocks 144 mounted to stand 20 as shown in FIGS. 1, 2 and 18. A sprocket wheel 146 is mounted on the axle 142 intermediate the bearing blocks 144 as shown in FIG. 1. A driver sprocket wheel 148 is mounted to an axle of a hydraulic motor 150 which is bolted to the stand 20 as shown in FIGS. 1 and 19. The hydraulic motor 150 is connected through a hydraulic hose 151 to a conventional valve assembly 222 as shown in FIG. 26. A continuous chain 152 is mounted on the driver sprocket wheel 148 and the sprocket wheel 146 as shown in FIGS. 18, 19 and 24.

Figure 20:
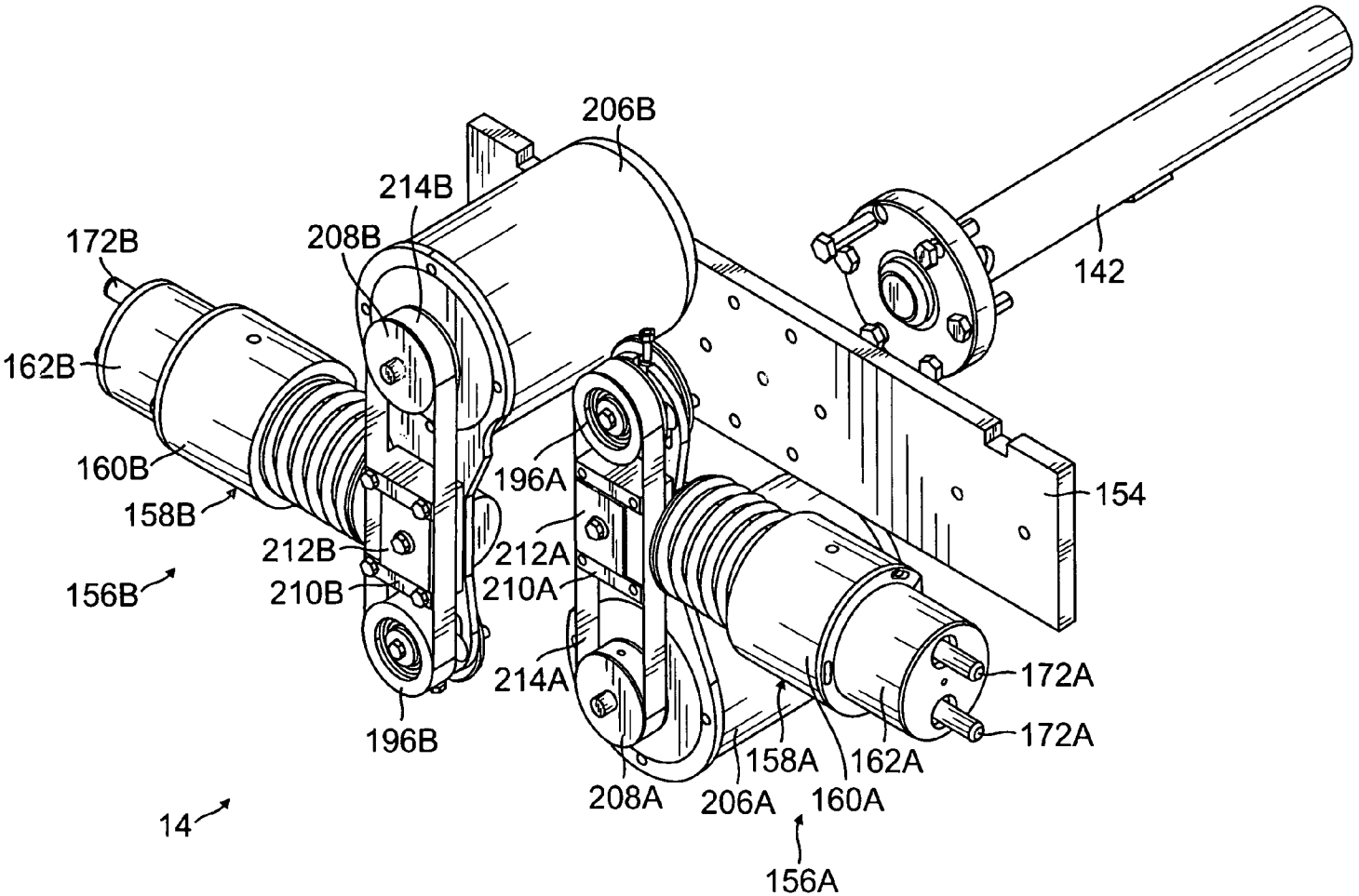
FIG. 20 is an exploded view of a portion of the main sanding assembly.
Figure 21B:
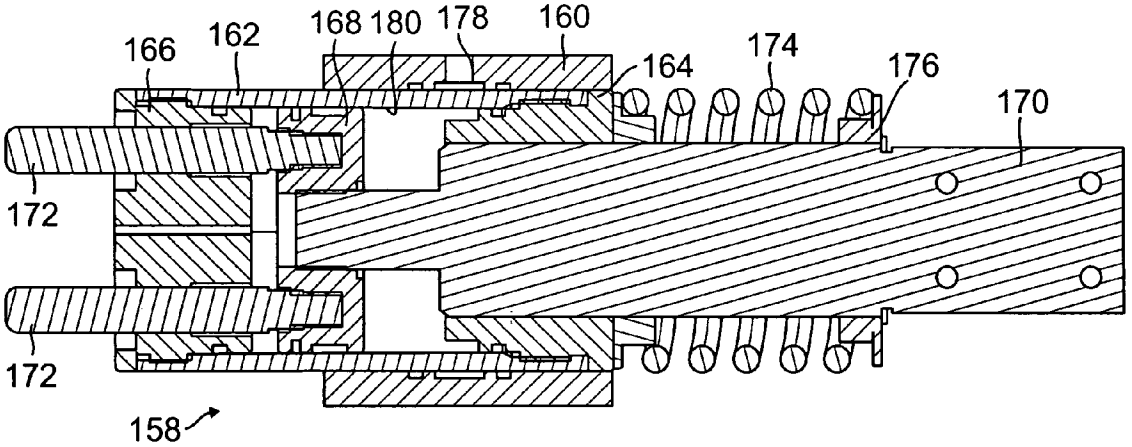
FIG. 21B is a cross sectional view taken along the line 21B-21B in FIG. 21A.
Figure 21A:
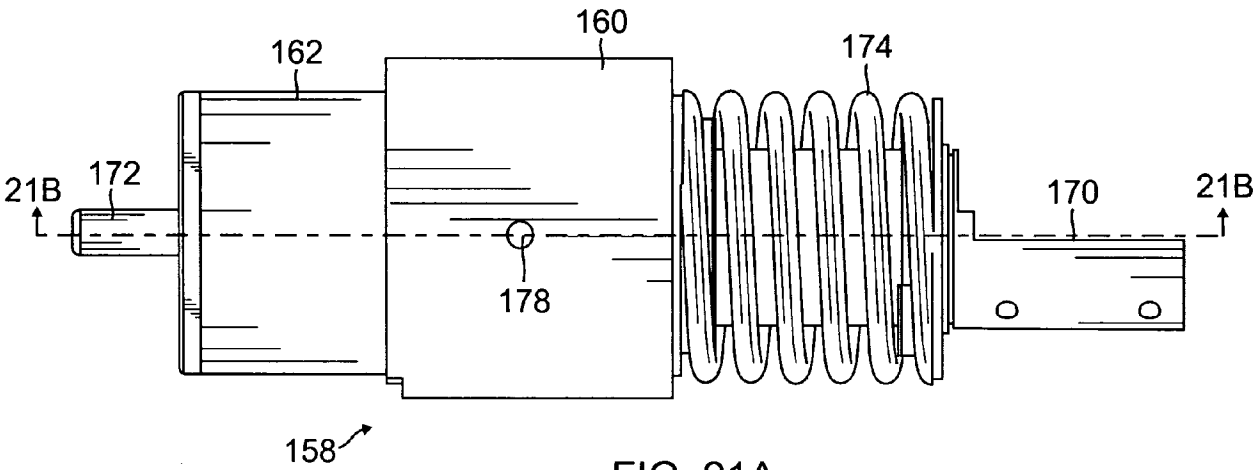
FIG. 21A is an elevational view of a hydraulic cylinder used with the main sanding assembly.

A support plate 154 is fixedly attached to an end of axle 142 for rotation with the axle 142 as shown in FIG. 20. The main sanding assembly 14 includes a pair of sanding assemblies 156A and 156B as shown in FIGS. 18 and 20 mounted to the support plate 154. The sanding assemblies 156A and 156B are of identical construction and the description below of one of the sanding assemblies will be the same for both. Reference to components of these assemblies may use the "A" or "B" label with the element number or may use the number alone which will refer to both. A hydraulic cylinder 158 used with the sanding assemblies 156A and 156B is shown in FIGS. 21A and 21B. The hydraulic cylinder 158 includes a collar 160 which mounts the hydraulic cylinder 158 to the support plate 154 as shown in FIG. 20. The hydraulic cylinder includes a housing 162 afixedly mounted to the collar 160. A forward gland 164 and the tail gland 166 are also mounted to the housing 162. The hydraulic cylinder further includes a hydraulic piston 168 connected to a shaft 170. A pair of anti-rotation rods 172 are slidably mounted in the tail gland 166 and engage the hydraulic piston 168. The anti-rotation rods 172 prevent the hydraulic piston 168 and shaft 170 from rotating during normal operation. A compression spring 174 is mounted between the forward gland 164 and a spring mount 176 afixedly secured to the shaft 170. The compression spring 174 resiliently biases the shaft 170 outwardly or to the right as shown in FIG. 21A. The collar 160 includes a hydraulic fluid input port 178 which is fluidly connected to the cavity 180. The hydraulic port is connected to a hydraulic hose 179 which in turn is connected to a conventional valve assembly 222. When hydraulic fluid is injected into cavity 180 the hydraulic piston 178 and the shaft 170 are moved to the left as shown in FIG. 21A.

Figure 22:
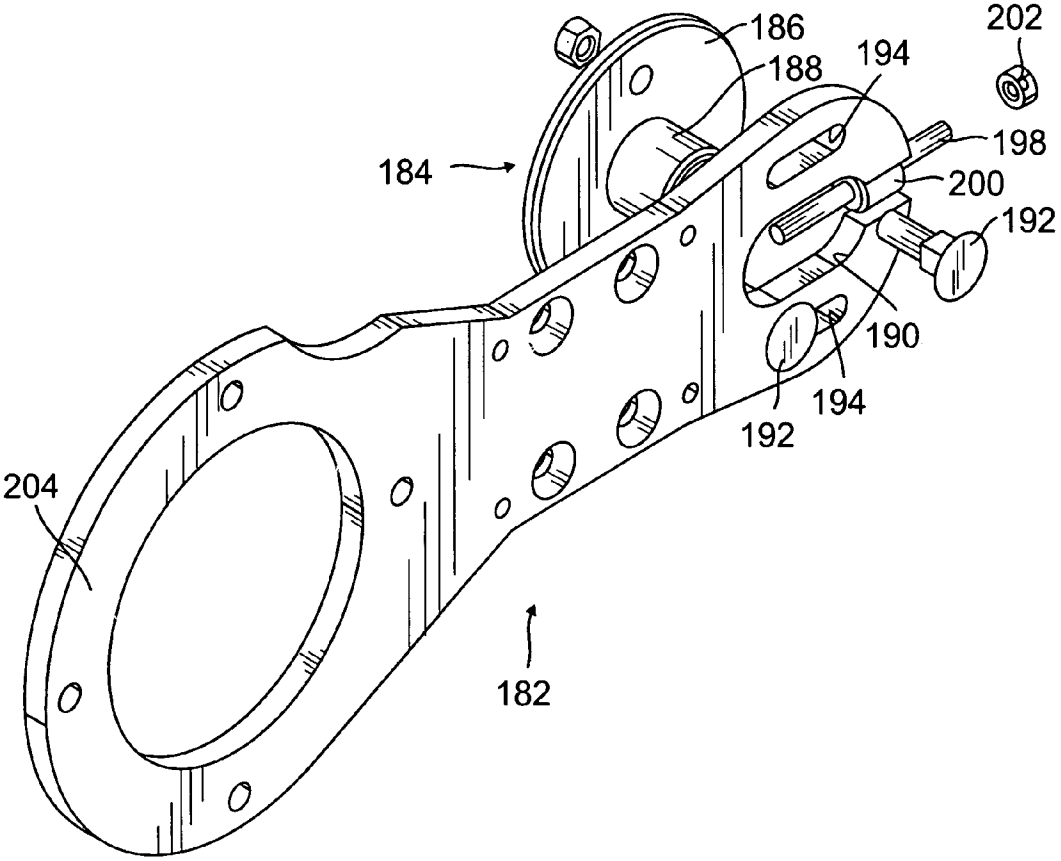
FIG. 22 is an exploded view of a motor mounting plate pulley assembly and pulley mounting assembly used with the main sanding assembly.
Figure 23:
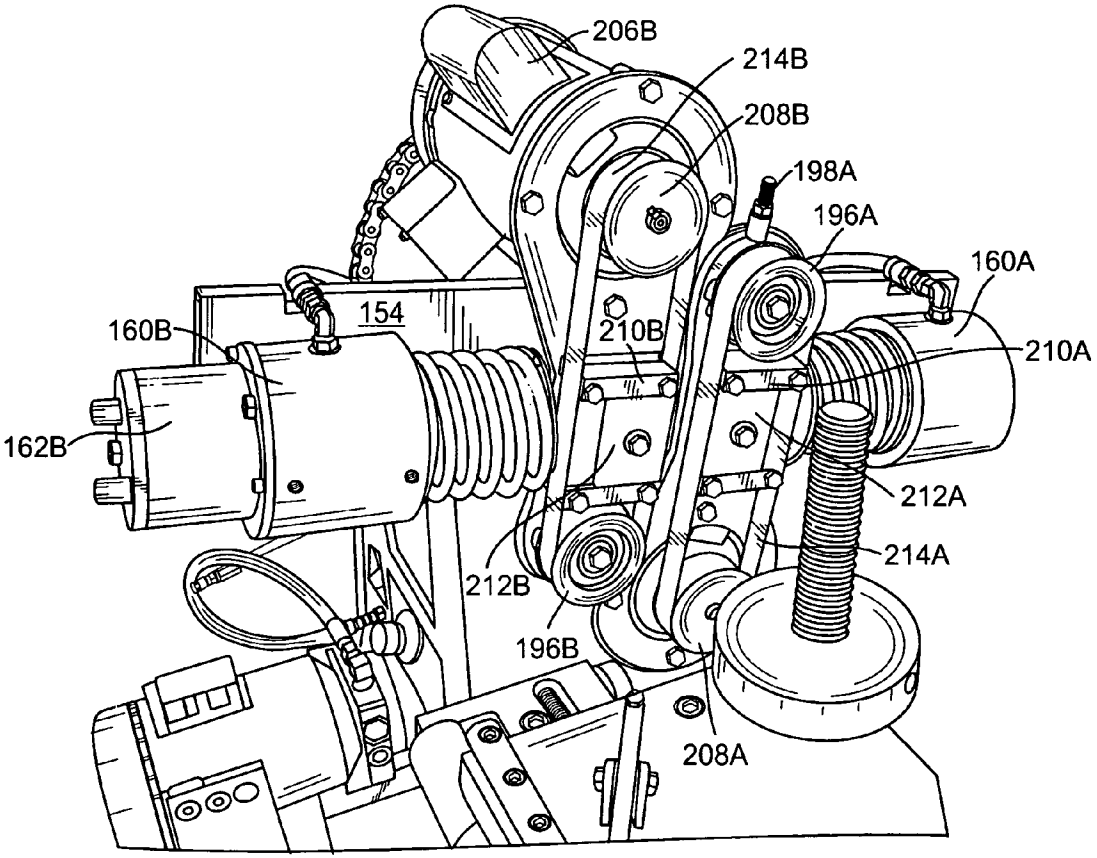
FIG. 23 is a partial perspective view of the main sanding assembly.
Figure 25:
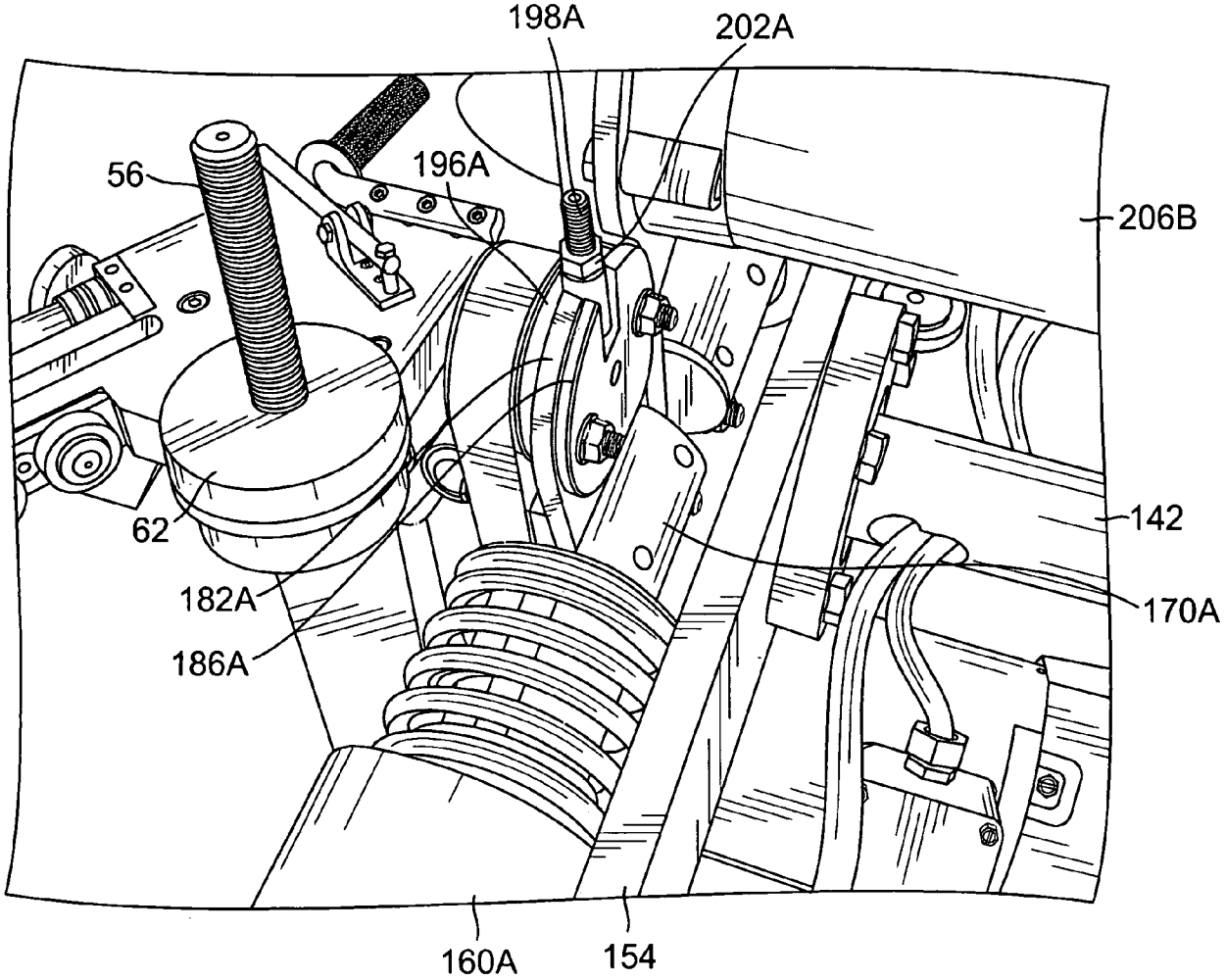
FIG. 25 is a detail view of a portion of the main sanding assembly.

An end of the shaft 170 is mounted to a motor mounting plate 182 as shown in FIG. 25. The motor mounting plate 182 is shown in FIG. 22. A pulley mounting assembly 184 includes a back plate 186 to which is attached a pulley mounting shaft 188. The shaft 188 extends through a slot 190 provided in the motor mounting plate 182. The back plate 186 is mounted to the motor mounting plate 182 with carriage bolts 192 extending through slots 194 provided in the motor mounting plate 182. An idler pulley 196 is mounted to the shaft 188 as shown in FIGS. 23 and 25. A tensioning screw 198 is slidably received by a shaft 200 welded to the motor mounting plate 182 as shown in FIGS. 22 and 25. An end of the tensioning screw 198 is fixedly secured to the shaft 188. A nut 202 threadably receives the tensioning screw 198. The nut 202 may be tightened or loosened to adjust the tensioning of the idler pulley 196.

The motor mounting plate 182 includes a portion 204 to which is bolted an electric motor 206 as shown in FIG. 20. A driver pulley 208 is mounted to the drive shaft of the motor 206. A sanding block 210 is mounted to the motor mounting plate 182. The sanding block 210 includes a slidable depth limiting plate 212. Sanding belts 214 are mounted on the pulleys 196 and 198 as shown in FIGS. 20 and 23. The depth limit plates 212 extend to the side of the sanding belts 214 and limit the depth of the cut. The depth limit plates 212 are slidably adjusted to a selected position.

Figure 27:
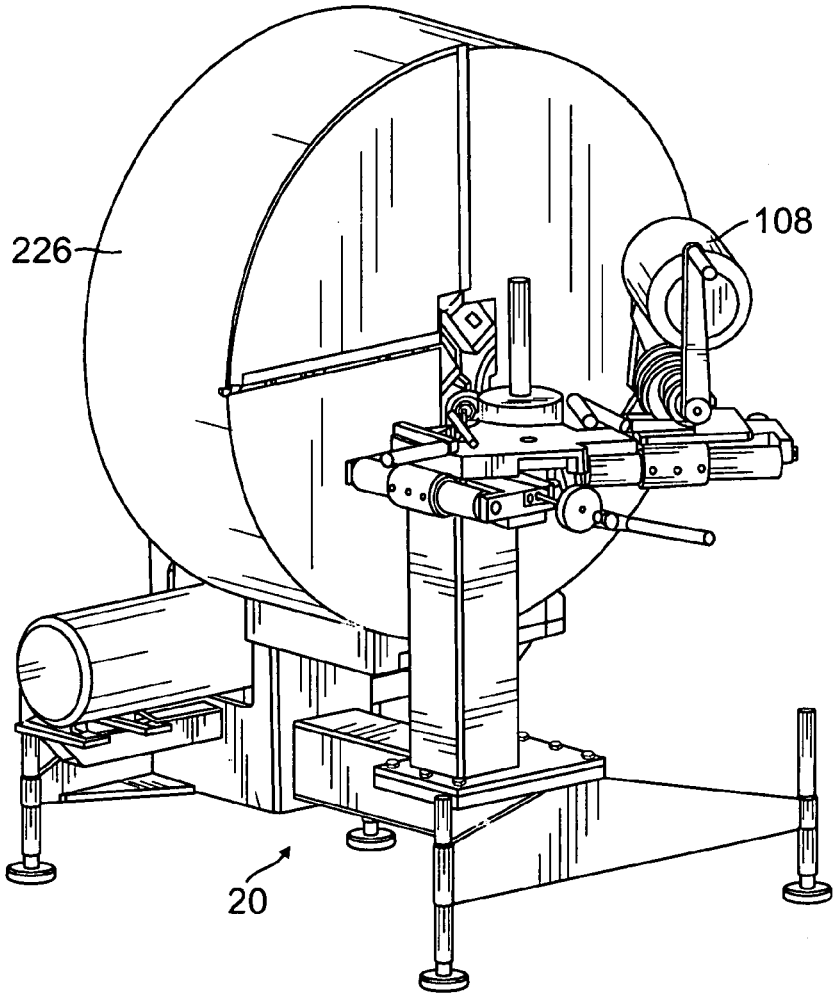
FIG. 27 is a perspective view of the apparatus shown in FIG. 1 with a cover for the main sanding assembly.

An electrical pump motor 216 drives a hydraulic pump 218 for pumping hydraulic fluid from a reservoir 220 to a conventional hydraulic valve assembly 222. A conventional electrical control system 224 is used to control the apparatus 10 as shown in the schematic diagram FIG. 26. A hydraulic system is used in a preferred embodiment although it is contemplated that a pneumatic system could be used equally as well. As shown in FIG. 27, a cover assembly 226 is preferably used to shield the components of the main sanding assembly 14.

In operation, the apparatus 10 is used for restoring a damaged hammer union 12. FIG. 2A shows a restored hammer union 12 and FIG. 2B shows a damaged hammer union 12. The hammer union has three lugs 228A, 228B and 228C spaced 120° apart around the circumference of the hammer union joint. Each lug has an end face 230 and four rectangular side faces 232, 234, 236 and 238. The apparatus 10 is used for cleaning all five faces. The auxiliary sanding assembly 16 is used for cleaning the face 230 and the main sanding assembly 14 is used for cleaning the faces 232-238.

A damaged hammer union 12 is placed on the bottom plate 76 and the top plate 78 is installed over the hammer union 12. The hammer union 12 is then rotated until a lug 228A faces the sanding belts 124. The nut 64 is threaded on post 56 to secure the hammer union 12 to the hammer union holder 18. Next the slide plate 40 is manipulated with handle 44 to slide plate 40 toward the main sanding assembly 14. The slide plate 40 is slid sufficiently to allow the pin 48 to drop into index hole 50. The handle 46 is used to move the pin 48 out of index hole 50 so that the slide plate 40 can be moved in the opposite direction.

Figure 28:
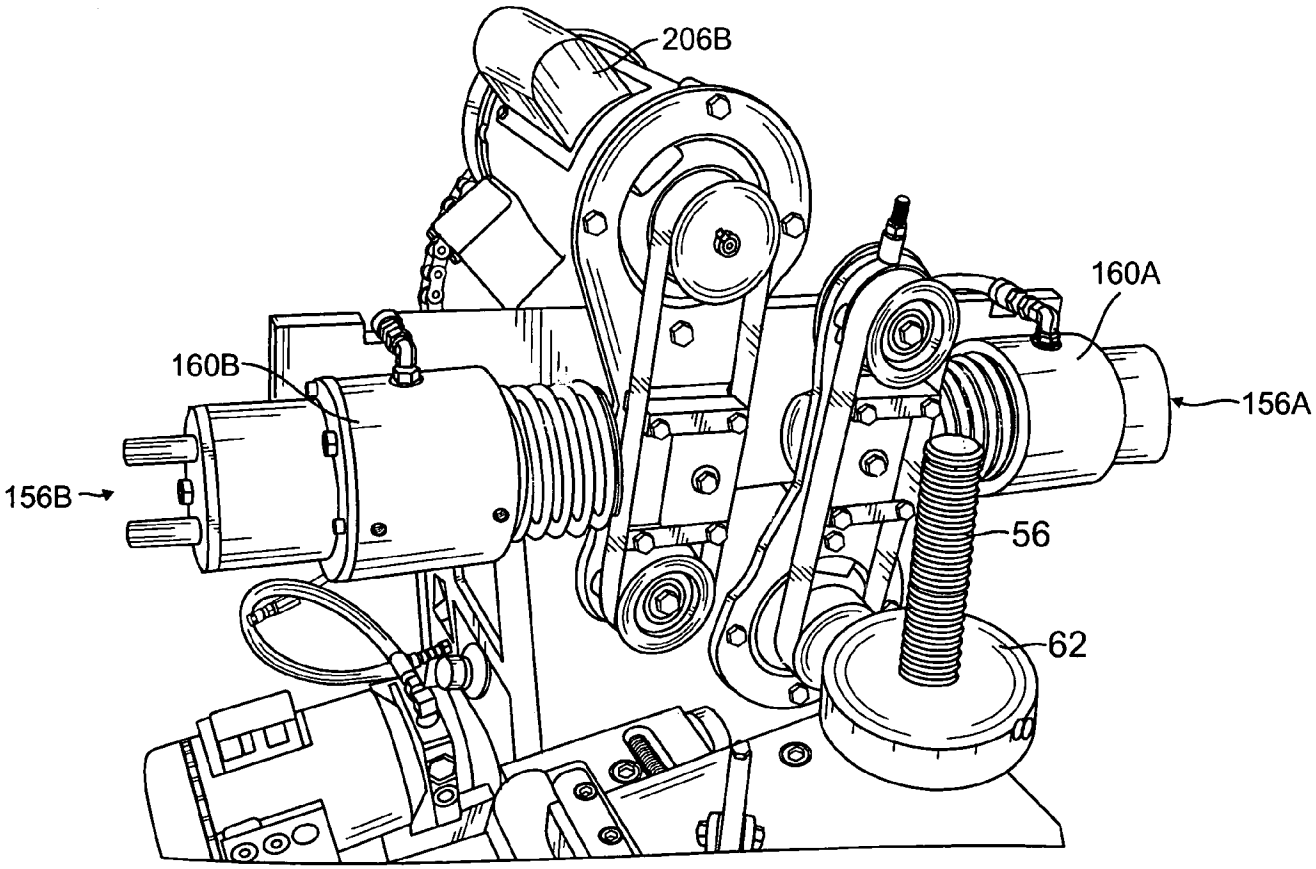
FIG. 28 is a partial view of the main sanding assembly with the sanding assemblies used with the present invention in a separated position.

The electrical control system 224 is then activated to direct hydraulic fluid into the hydraulic cylinders 158A and 158B. This causes the sanding assembly 156A and sanding assembly 156B to move away from each other from a position shown in FIG. 23 to a position shown in FIG. 28. The crank handle 36 is then rotated to slide the plate 40 to a position where a lug 228A is positioned between the sanding assemblies 156A and 156B. The electrical control system 224 is then used to deactivate the hydraulic cylinders 158A and 158B. The springs 174A and 174B cause the sanding assemblies 156A and 156B to close to a position where the sanding belts 214A and 214B rest against the faces 232 and 234 of a lug 218. The electrical control system 224 is then used to activate the sanding motors 206A, 206B and 108 and to activate the hydraulic motor 150 to rotate the sanding assemblies 156A and 156B 180° in one direction and then 180° in the opposite direction. Springs 174A and 174B allow the sanding assemblies 156A and 156B to float around the faces 232-238 allowing the sanding belts 214A and 214B to restore these surfaces. The depth limiters 212A and 212B are used to adjust the depth of the cut as these plates will abut the face to be restored when the proper depth is reached. To restore the face 230 of a lug 228B the auxiliary sanding assembly 16 is used. The handle 92 is used to slide the base plate 84 until the sanding belt 124 abuts the face 230. The handle 102 is then rotated forwardly and the sanding belt 124 is moved from the bottom edge of the lug 228B across the face 230 and across the upper edge of the face 230. The depth limiter plate 120 is used to limit the depth of the cut. The handle 92 is then used to slide the auxiliary sanding assembly 16 away from the hammer union 12 when the sanding is finished.

To continue the restoration operation, the sanding assemblies 156A and 156B are separated as before and the hammer union 12 moved out free of the sanding assemblies. Next, the handle 70 is pulled upwardly moving the pin 68 out of an index hole 74 of the post base 62 as shown in FIG. 9. The hammer union 12 is then rotated until the pin 68 is inserted into the next index hole 74 thereby aligning the next lug 228C with the sanding belts 124 of the auxiliary sanding assembly 16. At this point, the operation described previously will be repeated for restoring these lugs. The operation needs to be conducted three times to clean all three lugs.

While the fundamental novel features of the invention have been shown and described, it should be understood that various substitutions, modifications, and variations may be made by those skilled in the arts, without departing from the spirit or scope of the invention. Accordingly, all such modifications or variations are included in the scope of the invention as defined by the following claims:

I claim:

1. A hammer union restoration apparatus for restoring a hammer union having peripheral lugs each of which has an end face and four rectangularly positional side faces, the apparatus comprising:

a base; and a main sanding unit mounted to the base comprising:

a sander;

means for selectively positioning the sander from a position spaced apart from a side face of a lug to a position resting against the side face of the lug;

means for resiliently moving the sander in a direction away from the side face of the lug;

means for positioning a hammer union with a lug engagable with the sander;

means for actuating the sander;

a controllable motor; and means connected to the motor for rotating the sander relative to the lug around the four side faces of the lug.

2. The hammer union restoration apparatus according to claim 1 further including an auxiliary sanding unit mounted to the base comprising:

a sander;

means for selectively positioning the sander against an end face of a lug; and means for actuating the sander.

3. The hammer union restoration apparatus according to claim 1 wherein the sander of the main sanding unit includes a depth limiter plate and the sander of the auxiliary sanding unit includes a depth limiter plate.

4. A hammer union apparatus for restoring a hammer union having peripheral lugs each of which has an end face and four rectangularly positioned side faces, the apparatus comprising:

a base; and a main sanding unit mounted to the base comprising;

a pair of diametrically opposed sanders each selectively positionable from a position spaced apart from opposing side faces of a lug to a position resting against the opposing faces of the lug;

means for selectively moving the pair of sanders against opposing faces of the lug;

means for resiliently moving each sander in a direction away from a respective side face of the lug;

means for positioning a hammer union with a lug engageable with the pair of sanders;

means for simultaneously actuating the pair of sanders;

a controllable motor;

the pair of diametrically opposed sanders mounted to a support plate; and means connecting the support plate to the motor for rotating each sander 180° in one direction and 180° in the opposite direction when the sanders are positioned against respective side faces of the lug, whereby each sander sands two opposing faces of the lug.

5. The hammer union restoration apparatus according to claim 4 further including an auxiliary sanding unit mounted to the base comprising;

a sander;

means for selectively positioning the sander against an end face of a lug; and means for actuating the sander.

6. The hammer union restoration apparatus according to claim 5 wherein the sanders of the main sanding unit each include a depth limiter plate and the sander of the auxiliary sanding unit includes a depth limiter plate.

* * * * *